US005602573A

United States Patent [19]

Waschhauser et al.

[11] Patent Number: 5,602,573

[45] Date of Patent: Feb. 11, 1997

[54] SERVICE STATION FOR INKJET PRINTER HAVING WIPERS WITH CONCAVE WIPING EDGES

[75] Inventors: Heinz H. Waschhauser, Escondido; Michael H. Green, Pacific Beach, both of Calif.

[73] Assignee: Hewlett-Packard Company, Palo Alto, Calif.

[21] Appl. No.: 524,973

[22] Filed: Sep. 8, 1995

Related U.S. Application Data

[63] Continuation of Ser. No. 55,616, Apr. 30, 1993, abandoned.

[51] Int. Cl.[6] ..... B41J 2/165

[52] U.S. Cl. ..... 347/33; 347/24

[58] Field of Search ..... 347/24, 33; 15/245, 15/250.351, 250.361, 250.38

[56] References Cited

U.S. PATENT DOCUMENTS

| | | | |
|---|---|---|---|
| 3,192,551 | 7/1965 | Appel | 15/250.43 |
| 4,112,435 | 9/1978 | Kattner et al. | 347/33 |
| 4,340,897 | 7/1982 | Miller | 347/33 |
| 4,369,456 | 1/1983 | Cruz-Uribe et al. | 347/33 |
| 4,371,881 | 2/1983 | Bork et al. | 347/29 |
| 4,401,990 | 8/1983 | Aiba et al. | 347/33 |
| 4,437,105 | 3/1984 | Mrazek et al. | 347/29 |
| 4,450,456 | 5/1984 | Jekel et al. | 347/29 |
| 4,479,136 | 10/1984 | Lewis et al. | 347/33 |
| 4,528,996 | 7/1985 | Jones | 134/104.2 |
| 4,571,601 | 2/1986 | Teshima | 347/33 |
| 4,745,414 | 5/1988 | Okamura et al. | 347/30 |
| 4,746,938 | 5/1988 | Yamamori et al. | 347/28 |
| 4,829,318 | 5/1989 | Racicot et al. | 347/33 |
| 4,853,717 | 8/1989 | Harmon et al. | 347/29 |
| 4,928,120 | 5/1990 | Spehrley, Jr. et al. | 347/33 |
| 4,947,190 | 8/1990 | Mizusawa et al. | 347/33 |
| 4,951,066 | 8/1990 | Terasawa et al. | 347/33 |
| 4,959,673 | 9/1990 | Noda | 347/33 |
| 5,051,758 | 9/1991 | Markham | 347/28 |
| 5,051,761 | 9/1991 | Fisher et al. | 347/30 |
| 5,065,158 | 11/1991 | Nojima et al. | 347/33 |
| 5,081,472 | 1/1992 | Fisher | 347/33 |
| 5,097,276 | 3/1992 | Midorikawa | 347/32 |
| 5,103,244 | 4/1992 | Gast et al. | 347/33 |
| 5,115,250 | 5/1992 | Harmon et al. | 347/33 |
| 5,126,765 | 6/1992 | Nakamura | 347/33 |
| 5,138,334 | 8/1992 | Rowe et al. | 347/25 |
| 5,151,715 | 9/1992 | Ward et al. | 347/33 |
| 5,182,582 | 1/1993 | Okamura | 347/33 |
| 5,184,147 | 2/1993 | MacLane et al. | 347/30 |
| 5,208,939 | 5/1993 | Oulie | 15/245 |

FOREIGN PATENT DOCUMENTS

| | | | |
|---|---|---|---|
| 3-032848 | 2/1991 | Japan | B41J 2/165 |
| 3-222753 | 10/1991 | Japan | B41J 2/165 |
| 4-140147 | 5/1992 | Japan | B41J 2/165 |

*Primary Examiner*—Benjamin R. Fuller
*Assistant Examiner*—David Yockey

[57] ABSTRACT

Wiping and capping method and apparatus for use with an inkjet printer are described. The apparatus includes a sled that is mounted to a printer's chassis. Caps and wipers can be mounted on the sled for each of the printer's movable carriage-mounted printheads. The wipers are mounted by a friction-fit connection and deformed around the wiper mounts such that wiping edges of the wipers are concave. The sled and the chassis are cam-coupled for controlled, relative movement therebetween. The sled and the carriage are also cam-coupled for controlled, relative movement therebetween. Movement of the carriage produces slight vertical and lateral movement of the sled out of its nominal position to place it in three primary positions relative to the carriage: an elevated position for capping the printheads, an intermediate position for wiping the printheads and a lowered position for free reciprocal movement of the carriage without interference between the printheads and either the caps or the wipers. The sled is mounted to ensure constant capping force between the caps and their corresponding printheads.

7 Claims, 15 Drawing Sheets

SERVICE STATION FOR INKJET PRINTER HAVING WIPERS WITH CONCAVE WIPING EDGES

CROSS REFERENCE TO RELATED APPLICATION

This is a continuation of application Ser. No. 08/055,616 filed on Apr. 30, 1993, now abandoned.

CROSS-REFERENCE TO RELATED APPLICATIONS

This application is related to and incorporates by reference co-pending U.S. patent application Ser. No. 07/949,197, entitled "Ink-jet Printhead Capping and Wiping Method and Apparatus," filed by William S. Osborne on Sep. 21, 1992, and assigned to the same assignee as the present application. This application is also related to and incorporates by reference the U.S. patent application entitled "Service Station for Inkjet Printer Having Reduced Noise, Increased Ease of Assembly and Variable Wiping Capability," attorney docket no. 1093129-1, filed by Heinz H. Waschhauser and William S. Osborne on the same date as the present application, and assigned to the same assignee as the present application.

BACKGROUND OF THE INVENTION

1. Field of the Invention

The present invention relates generally to inkjet printers and, in particular, to a method and structure for wiping and capping the printheads of one or more print cartridges. Most particularly, the invention relates to a method and structure that depend upon printer carriage motion for automatic wiping and capping of each printhead, that utilizes uni-directional, separate wiping action for each printhead, that caps each printhead with a constant capping force and that reduces noise associated with operation of the capping and wiping structure.

2. Related Art

Inkjet printhead nozzles commonly become plugged with ink blobs or particulate therein, or otherwise contaminated with internal bubbles that prevent them from operating properly. Lower print quality and user complaints often result. Conventional service mechanisms typically provide for the spitting, wiping and capping of single printheads, frequently require operator intervention and often take the printer off-line for several seconds. Wiping an inkjet printhead in two directions, or wiping multiple printheads with a single wiper surface, results in recontamination of a printhead during wiping or inter-printhead contamination.

Improved capping systems have been proposed that provide for constant-force, rather than constant-deflection, capping of plural printheads in inkjet printers. One such capping system is described in co-pending U.S. patent application Ser. No. 07/935,606, entitled "Ink-jet Printhead Cap Having Suspended Lip," filed on Aug. 26, 1992, and assigned to the assignee of the present invention. The disclosure of that co-pending patent application is incorporated herein by this reference.

Failure recovery methods and systems have been proposed that provide for the automatic recovery from a condition in a plural printhead inkjet printer in which the printhead's nozzles become clogged with ink and particulate, wherein the method includes capping the printheads, selectively priming and flushing a given printhead and then uncapping and wiping the printheads. One such method and system is described in copending U.S. patent application Ser. No. 07/949,318, entitled "Automatic Failure Recovery for Ink-jet Printheads," filed on Sep. 21, 1992, and assigned to the assignee of the present invention. The disclosure of that co-pending patent application also is incorporated herein by this reference.

Movement of a sled in a service station often results in impacts between the sled and surrounding parts of the printer. The impacts create undesirable levels of noise during operation of the printer.

Previously, wiper blades have been made of rubber. However, "shingling" of the wiper blades can result after prolonged used of the wiper blades, particularly in low humidity and low temperature environments. Shingling is a microscopic defect on the surface of the wiper blade that, during wiping, can cause air bubbles to be transmitted into the nozzles of the print cartridge. These air bubbles can cause ink to be displaced from the firing chamber of the print cartridge so that the print cartridges will not print, necessitating priming of the print cartridge in order to restore printing capability.

Additionally, in previous wiping systems, the wiper blades have been mounted below a surface of the sled and extended through a hole in the surface. Consequently, the wiper blades have been relatively long. As a result, the wiper blades have not been as stiff as desired. Generally, it is desirable to make the wiper blades as stiff as possible, without damaging the printhead, so that the most effective wiping will be obtained. This is particularly true for print cartridges containing black ink.

SUMMARY OF THE INVENTION

An apparatus according to the invention includes a sled that is mounted to a printer's chassis, the sled mounting pairs of caps and wipers for each of the printer's movable carriage-mounted printheads. The sled and the chassis are cam-coupled for controlled, relative movement therebetween. The sled and the carriage are also cam-coupled for controlled, relative movement therebetween. Movement of the carriage produces slight vertical and lateral movement of the sled out of its nominal position to place it in three primary positions relative to the carriage: an elevated position for capping the printheads, an intermediate position for wiping the printheads and a lowered position for free reciprocal movement of the carriage without interference between the printheads and either the caps or the wipers. Thus, a controller that includes only the printer's carriage drive motor provides printer servicing, including capping and wiping.

A method according to the invention involves uncapping the printheads, wiping the printheads uni-directionally, lowering the sled to its free position beneath the printheads, optionally re-wiping the printheads repeatedly, and returning the printheads to their capped position. During the wiping operation, one or more of the printheads also may be spitted to wet the corresponding wiper. The method and apparatus of the invention are compatible with automatic priming of selected ones of the printheads.

Capping is done with a constant force. Wiping is uni-directional, thereby avoiding recontamination of a printhead that may occur, if bi-directional wiping is used, during a return wipe. Importantly, there is no permanent lock-out state of the method and apparatus from which printing cannot resume without operator intervention.

An apparatus according to the invention includes a sled that is gimbal-mounted to a printer's chassis, the sled mounting plural pairs of caps and wipers for each of the printer's movable carriage-mounted printheads. The sled and the chassis are cam-coupled for controlled, relative movement therebetween. The sled and the carriage are also cam-coupled for controlled, relative movement therebetween. Movement of the carriage produces slight vertical and lateral movement of the sled out of its nominal position to place it in three primary positions relative to the carriage: an elevated position for capping the printheads, an intermediate position for wiping the printheads and a lowered position for free reciprocal movement of the carriage without interference between the printheads and either the caps or the wipers. Thus, a controller that includes only the printer's carriage drive motor provides printer servicing, including capping and wiping.

The method according to the invention involves uncapping the printheads, wiping the printheads uni-directionally, lowering the sled to its free position beneath the printheads, optionally re-wiping the printheads repeatedly, and returning the printheads to their capped position. During the wiping operation, one or more of the printheads also may be spitted to wet the corresponding wiper. The method and apparatus of the invention are compatible with automatic priming of selected ones of the plural printheads.

Capping is done with a constant force imparted by the gimbal-mounted sled, which gimbal takes the form of plural spring elements. Wiping is uni-directional, thereby avoiding recontamination of a printhead that may occur, if bi-directional wiping is used, during a return wipe. Importantly, there is no permanent lock-out state of the method and apparatus from which printing cannot resume without operator intervention.

According to one embodiment of the invention, the wiper or wipers are made of a material having a hardness between 60–85 durometer Shore A. In another embodiment, the wiper material is polyurethane. Wipers made of polyurethane avoid the shingling problem encountered in the prior art. In yet another embodiment, a wiping structure includes a plurality of wipers formed integrally.

In other embodiments according to the invention, the wipers are made stiffer than prior art wipers. This can be done by, for instance, chamfering opposite ends of the wiper, making the wipers relatively thick at the base and/or mounting the wipers such that the top edge of the wiper is slightly concave. If desired, one of the wipers can be made stiffer than the other wipers by, for instance, making the wiper thicker than the other wipers.

DETAILED DESCRIPTION OF EMBODIMENTS OF THE INVENTION

Figure 1A:
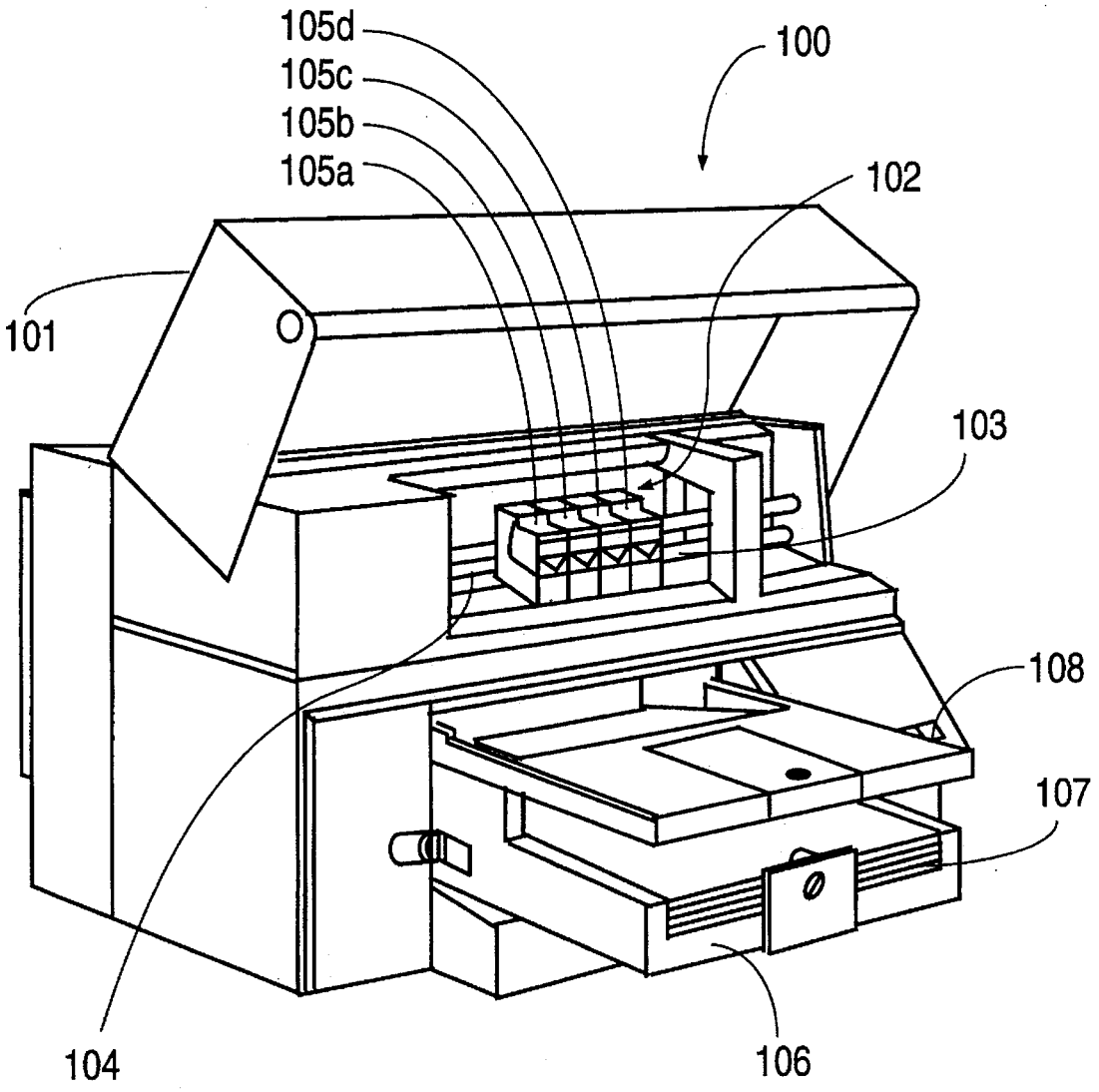
FIG. 1A is a simplified perspective view of an inkjet printer according to the invention illustrating a printing mode of operation.

FIG. 1A is a simplified perspective view of printer 100 according to the invention. Lid 101 of printer 100 encloses print carriage 102 in which four print cartridges 105*a*, 105*b*, 105*c*, 105*d* (also known as "pens," "printhead cartridges," or "cartridges") are inserted, as explained in more detail below. Print carriage 102 is mounted on slider bar 103 such that a printhead (not shown) on each of print cartridges 105*a*, 105*b*, 105*c*, 105*d* is adjacent print medium 104, e.g., paper, which is supported as described in detail in co-pending commonly owned U.S. patent application entitled "Traction Surface for Print Media Feed of a Heated Printer," attorney docket no. 1093159-1, filed by David C. Burney, Damon W. Broder and G. Franklin Nasworthy, Jr. on the same date as the present application. The pertinent disclosure of that application is herein incorporated by reference.

Print medium 104 is fed from print media input stack 107 in input tray 106 through a print medium feed mechanism (not shown). Print medium 104 is then advanced by rollers (not shown) in a direction perpendicular to slider bar 103 while print carriage 102 is moved back and forth on slider bar 103 (explained in more detail below with respect to FIG. 1C). As the print cartridges 105*a*, 105*b*, 105*c*, 105*d* move relative to print medium 104, ink is ejected through nozzles formed in each of the printheads. Ink is held in a reservoir within each of print cartridges 105*a*, 105*b*, 105*c*, 105*d*. Typically, each print cartridge 105*a*, 105*b*, 105*c*, 105*d* contains a different color of ink, e.g., black, cyan, magenta, yellow. The ink passes through channels formed in each print cartridge 105*a*, 105*b*, 105*c*, 105*d* to firing chambers formed in each print cartridge 105*a*, 105*b*, 105*c*, 105*d* in the vicinity of the nozzles. The ink in the firing chamber is heated and vaporized, the vapor bubbles in the ink causing a droplet of ink to be ejected through an associated nozzle onto print medium 104. The nozzles in the printhead of each print cartridge 105*a*, 105*b*, 105*c*, 105*d* are arranged in a pattern, such as a rectangular matrix, and ink selectively ejected onto print medium 104 so that desired characters or other images are printed on print medium 104.

Though, in the description above, the print carriage 102 contains four print cartridges 105*a*, 105*b*, 105*c*, 105*d*, each print cartridge 105*a*, 105*b*, 105*c*, 105*d* containing either black, cyan, magenta or yellow ink, it is to be understood that other numbers of print cartridges can be used, e.g., three print cartridges, and other colors of ink can be used, e.g., red, green and blue. The invention also encompasses, for example, printers including only one print cartridge.

Figure 1B:
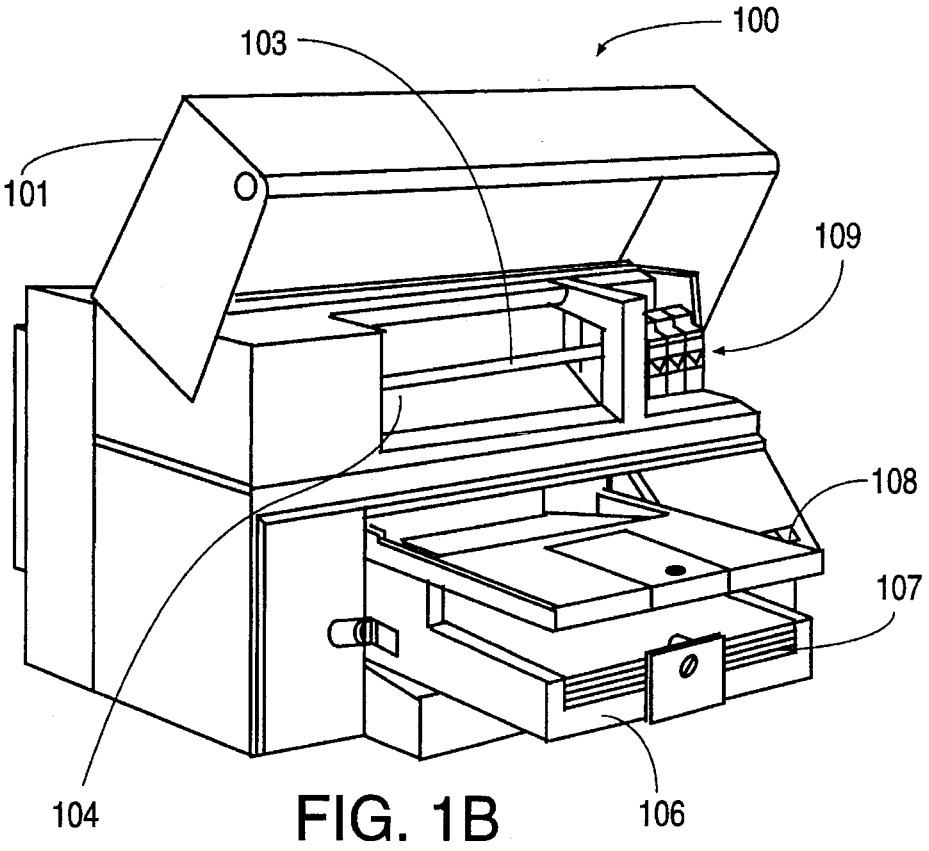
FIG. 1B is a simplified perspective view of the inkjet printer of FIG. 1A illustrating a non-printing mode of operation in which the print cartridges are capped.

As part of operation of printer 100, it is necessary to perform certain maintenance operations on the printheads of the print cartridges 105*a*, 105*b*, 105*c*, 105*d*. FIG. 1B is a simplified perspective view of printer 100 illustrating a non-printing mode of operation in which print cartridges 105*a*, 105*b*, 105*c*, 105*d* are capped in a service station, indicated generally by reference numeral 109. The service station 109 (described in more detail below) is provided in printer 100 for performing print cartridge maintenance operations, which include wiping, priming and spitting, and for storing (capping) print cartridges 105*a*, 105*b*, 105*c*, 105*d* when print cartridges 105*a*, 105*b*, 105*c*, 105*d* are not being used for printing.

Figure 1C:
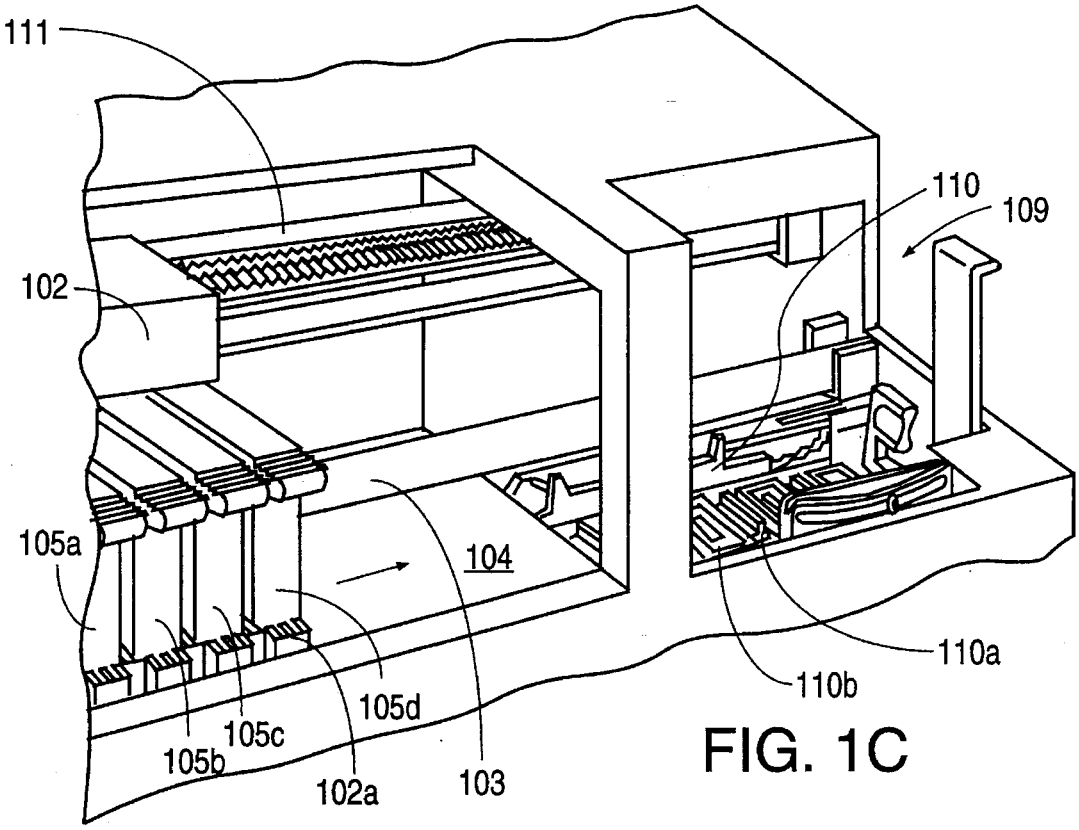
FIG. 1C is a perspective view of a portion of FIG. 1A.

FIG. 1C is a perspective view of a portion of FIG. 1A. Endless belt 111 is used to drive print carriage 102 along slider bar 103 in a conventional manner. A conventional linear encoder strip (not shown) is utilized, as is known in the art, to detect the position of print carriage 102 as it moves back and forth adjacent print medium 104, so that carriage 102 can be appropriately positioned during printing. Print carriage 102 is also mounted to a guide rail (not shown) to prevent print carriage 102 from rotating about slider bar 103.

Each of print cartridges 105*a*, 105*b*, 105*c*, 105*d* is held in place in a corresponding stall of print carriage 102 by a friction fit. A resilient arm 102*a* protrudes from a bottom surface of each of the stalls so that each print cartridge 105*a*, 105*b*, 105*c*, 105*d* is fitted into the corresponding stall by "snapping" the print cartridge 105*a*, 105*b*, 105*c* or 105*d* into place such that the corresponding resilient arm prevents the print cartridge 105*a*, 105*b*, 105*c* or 105*d* from moving in a direction perpendicular to slider bar 103. Springs (not shown) are attached to a side of each stall such that when each print cartridge 105*a*, 105*b*, 105*c*, 105*d* is snapped into place in the corresponding stall, the springs are compressed and apply a force to the print cartridge 105*a*, 105*b*, 105*c* or 105*d* to prevent the print cartridge 105*a*, 105*b*, 105*c* or 105*d* from moving laterally (i.e., parallel to slider bar 103) within the stall.

In FIG. 1C, it is seen that the service station 109 includes sled 110 which is used in the wiping and capping operations. As explained in more detail below, when print cartridges 105*a*, 105*b*, 105*c*, 105*d* are not being used for printing, print carriage 102 is moved to service station 109 and lowered to a capping position such that each print cartridge 105*a*, 105*b*, 105*c*, 105*d* contacts a corresponding cap 110*b* so that the printhead of each print cartridge 105*a*, 105*b*, 105*c*, 105*d* is surrounded by the corresponding cap 110*b*. Print cartridges 105*a*, 105*b*, 105*c*, 105*d* are capped when not in use to prevent the nozzles in the printheads from drying out.

Wipers 110*a* in the service station 109 wipe the printhead of each print cartridge 105*a*, 105*b*, 105*c* or 105*d* to remove contaminants or crusted ink that may block the printhead nozzles. Each of the wipers 110*a* wipes only one of the print cartridges 105*a*, 105*b*, 105*c* and 105*d* as the print carriage 102 moves into or out of the service station 109.

The service station 109 is also used for priming. If, for some reason, ink is no longer in the firing chamber adjacent one or more of the nozzles, so that ink is not being ejected from the nozzle, a vacuum can be applied through the nozzle while printer carriage 102 is in the capping position to draw ink from the ink reservoir of the print cartridge 105*a*, 105*b*, 105*c* or 105*d* into the firing chamber.

The service station 109 can also be used for spitting. When print cartridges 105*a*, 105*b*, 105*c* or 105*d* have been capped for a lengthy period of time, before printing again it is necessary to "spit," i.e., eject a couple of hundred drops of ink to clear crusted ink from the nozzle. This operation is performed while print carriage 102 sits on sled 110 in service station 109.

FIGS. 2A through 2H are a series of simplified front elevations of an inkjet wiping and capping apparatus (i.e., service station), made in accordance with an embodiment of the invention, showing various phases of the apparatus' operation. It will be appreciated that FIGS. 2A through 2H show, fragmentarily and in greatly simplified form, an inkjet printer 10 in front elevational view. (It also will be appreciated that, for the sake of clarity, only FIG. 2A carries all referenced numerical designators.) The printer's chassis, or base 12, is shown only fragmentarily and in greatly simplified form. Gimbal-mounted to chassis 12 is a floating sled 14 that mounts in a linear array of one or more caps 16 (having printhead-sealing lips at their upper extents), and wipers 18 (having upper terminal ends or wiping surfaces) on a generally planar support member 20. Sled 14 is positioned beneath the printer's movable carriage 22, which is shown only fragmentarily, which carriage 22 will be understood to mount plural printheads 19 (not shown in FIGS. 2A–B and 2E through 2H) the operative bottom surfaces of which define a first substantially horizontal plane P indicated in FIGS. 2A through 2H as a dashed line.

Each of wipers 18 is operatively associable with a corresponding printhead, as is each cap 16. Sled 14, which is gimbal mounted to chassis 12 by plural spring elements 24, may be seen from FIGS. 2A through 2H to be cam-coupled with chassis 12 for controlled relative movement therebetween. Sled 14 also is cam coupled with carriage 22, which mounts the printheads, for controlled relative movement therebetween. As will be seen, this dual cam coupling of sled 14 with relatively fixed chassis 12 and relatively movable carriage 22 produces slight vertical and horizontal, e.g., lateral, movement of sled 14 in response to controlled, reciprocal, horizontal movement of carriage 22 relative to chassis 12. Such reciprocal movement of carriage 22 relative to chassis 12, in accordance with the method and apparatus of the invention, automatically is provided by the printer's carriage controller.

In a service mode of operation of the printer 10, cam-coupled sled 14 and chassis 12, and cam-coupled sled 14 and carriage 22, responsive to the controller and movement of carriage 22 undergoes programmed vertical and lateral movement that results in the placement of caps 16 and wipers 18 in predefined uncapping, wiping and recapping positions relative to their corresponding printheads. It will be appreciated that the printer carriage's singular drive motor is operated in common with both the service mode described herein and with the normal printing mode of operation of the printer.

Figure 5:
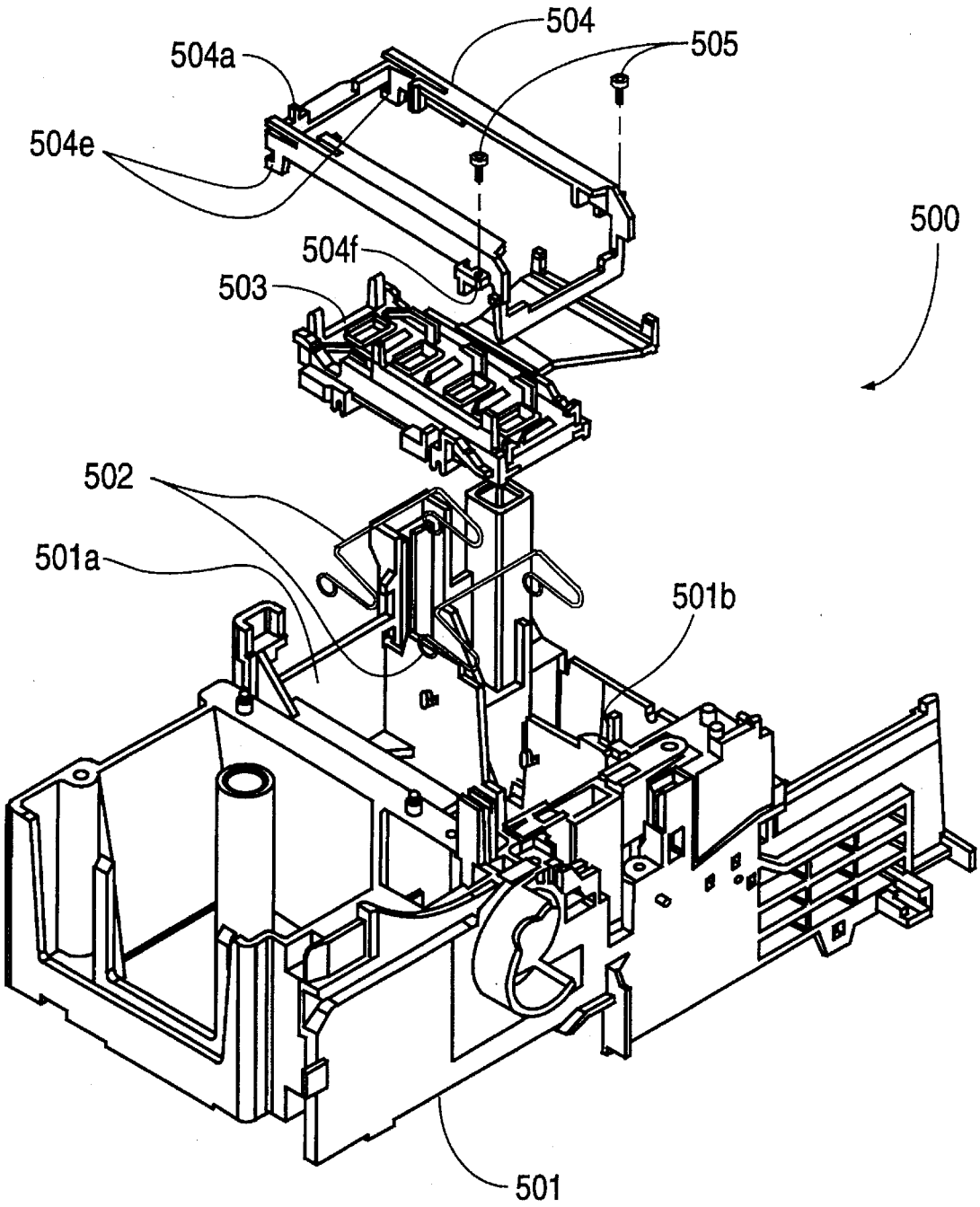
FIG. 5 is an exploded perspective view of a service station for use with an inkjet printer according to the invention illustrating the assembly of the service station.
Figure 6:
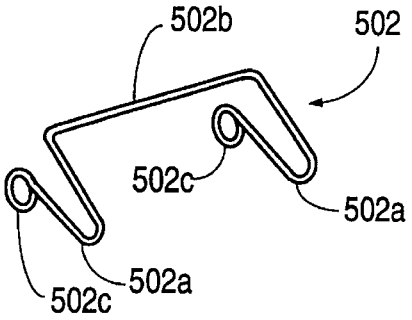
FIG. 6 is a perspective view of a spring used with the service station of FIG. 5.
Figure 10:
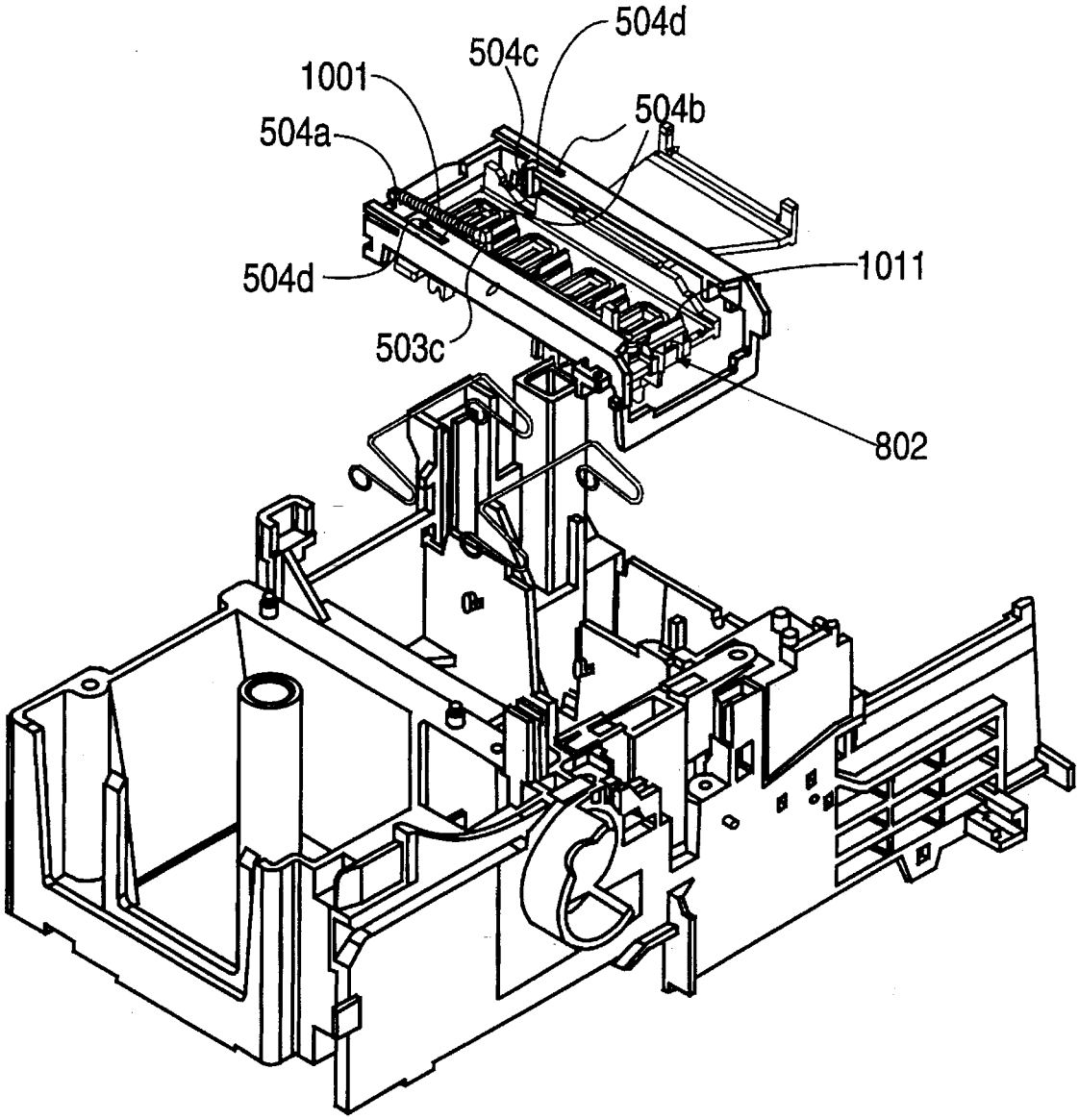
FIG. 10 is an exploded perspective view of the service station of FIG. 5, partially assembled, including an additional spring for reducing noise associated with the operation of service station.

Importantly, gimbal-mounting of sled 14 to chassis 12, by way of plural spring elements or members 24, produces a substantially constant force between the printheads and wipers 18 (for wiping), and between the printheads and caps 16 (for capping) by upward forces imparted through sled 14 normal to plane P. Each of spring elements 24 is made of, for instance, spring steel and is mounted rotatably on one end to a capture post (indicated schematically as a simple circle) on chassis 12 and on the other end to a capture post (identically indicated) on sled 14. Spring elements 24 are generally V-shaped, as shown, and have a nominal angle between their radially extending arms of approximately 31.9° and provide approximately 0.4 pounds of force (1.8 N) at 10.4 mm (0.409 inches) of compression from their nominal 24.2 mm (0.953 inches) span. In one embodiment, the spring elements 24 are flat leaf springs. In another embodiment, the spring elements 24 are wire springs, as shown in FIGS. 5, 6 and 10, and described in more detail below.

It will be appreciated that such constant-force capping and wiping reduces wear on the lips of caps 16 and on the upper terminal ends, or wiping surfaces, of wipers 18, which may be brought into frequent contact with the lower planar surfaces of the printheads. No less importantly, such gimbal-mounting with spring elements 24 defines a nominal position of sled 14 and a substantially horizontal plane that is parallel with plane P defined by the lower surfaces of the printheads. Finally, and most importantly, stored energy in spring elements 24 provides the force necessary to urge sled 14 through its various vertical and lateral movements that are controlled by the above-described cam-coupling arrangement. Such cam action-controlled horizontal and vertical movement of sled 14 relative to chassis 12 thus requires no external motive force, e.g., a dedicated drive motor, but instead is produced very simply and cost effectively by horizontal movement between carriage 22 and chassis 12.

Referring still to FIGS. 2A through 2H, sled 14 may be seen to include first cam surfaces **14*a* (having predefined, nearly identical profiles, as shown in FIGS. 2A through 2H, where it may be seen that left cam surface 14*a* has a pronounced vertical step defining a temporary stop S, whereas right cam surface 14*a* has an inclined corresponding step also defining temporary stop S) engaged with corresponding second cam follower members 12*a* of chassis 12. Sled 14 further may be seen to include first cam follower members 14*b* extending upwardly from sled 14, with first cam follower members 14*b* being engaged with corresponding second cam surfaces 22*a*, 22*b* of carriage 22. Four such first cam surfaces 14*a* and first cam follower members 14*b* are provided along the perimeter of generally plano-rectangular sled 14, thus to horizontally stabilize sled 14, although for reasons of clarity and brevity only two each are shown in FIGS. 2A through 2H. (Correspondingly, four second cam follower members 12*a* are provided on chassis 12 and two each second cam surfaces 22*a*, 22*b* are provided on carriage 22, although only two and one each, respectively, are shown in FIGS. 2A through 2H**.)

In another embodiment of the invention, the position of the left and right first cam surfaces **14*a* are reversed, as compared to the embodiment of the invention shown in FIGS. 2A–2H. In FIG. 3 (which, except for cam surfaces 14*a*, is identical to FIG. 2A), an inkjet printer 30 temporary stop S for the right cam surface 14*a* is defined by a pronounced vertical step, and the temporary stop S for the left cam surface 14*a*** is defined by an inclined corresponding step.

During the wiping of the printheads 19, contact of each of the printheads with the corresponding wiper 18 imparts a force to the sled 14. Locating the left and right first cam surfaces **14*a* as shown in FIG. 3 results in more even distribution of these forces over the sled 14, so that the sled 14** is retained better in the wiping position during the wiping of the printheads.

Sled 14, including at least cam surfaces **14*a*, is unitary, injection molded from a polymer material having a teflon filler. In order to provide a suitably low coefficient of friction between cam surfaces 14*a* and cam follower members 12*a* of the chassis, cam follower members 12*a*** are same-polymer injection molded parts, but the polymer material has no teflon filler. It has been found that these materials provide for smooth cam action and durability. Obviously, other suitable materials may be used, although of course lightweight, easily and inexpensively manufactured parts are preferred.

Figure 2A:
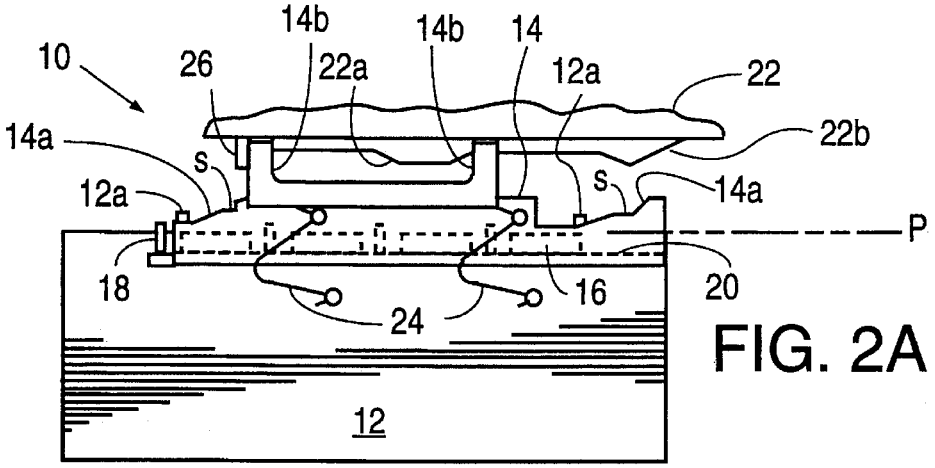
FIGS. 2A through 2H are a series of simplified front elevations of an inkjet wiping and capping apparatus, made in accordance with an embodiment of the invention, showing various phases of the apparatus' operation.
Figure 2B:
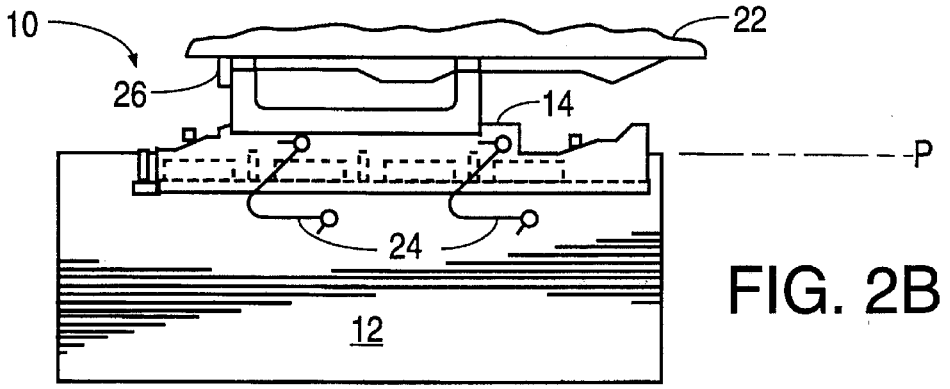
Figure 3:
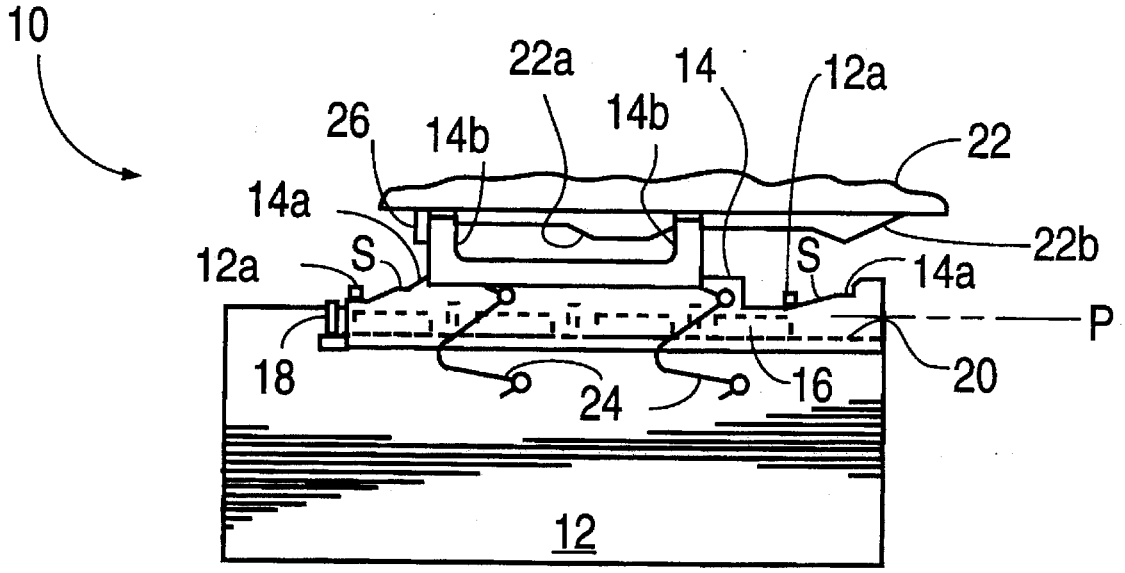
FIG. 3 is a simplified front elevation of an inkjet wiping and capping apparatus, similar to FIG. 2A, made in accordance with another embodiment of the invention.

In service operation involving uncapping, wiping and recapping the printheads, the printheads first are uncapped, as may best be seen by contrasting FIGS. 2A and 2B, by relative movement between chassis 12 and sled 14, with first cam surfaces **14*a* of sled 14 and second cam follower members 12*a* of chassis 12 producing substantially vertical downward movement of sled 14 relative to carriage 22, the relative movement between chassis 12 and sled 14 being produced by an end stop member, or end stop, 26 mounted on carriage 12 adjacent an extreme end of second cam surfaces 22*a*, 12*b***.

Thus, FIG. 2A may be seen to illustrate a capping position in which the plane defined by the lower surface of the printheads nominally, but with slight interference fit, is coplanar with the plane defined by the lips of caps 16, whereas FIG. 2B may be seen to illustrate an uncapped position of the printheads in which sled 14 is at an intermediate, wiping position or elevation in which the plane P defined by the printheads nominally, with slight interference fit, is coplanar with a plane defined by the wiping surfaces of wipers 18. By the dual cam action provided between (1) first cam surfaces **14*a* of sled 14 and second follower members 12*a* of chassis 12, and (2) second cam surfaces 22*a*, 22*b* of carriage 22 and first follower members 14*b* of sled 14, no horizontal movement between sled 14 and chassis 22 occurs, but a downward vertical movement of sled 14 relative thereto does occur, thereby to remove sled 14 from a printhead capping to a printhead wiping position. It will be appreciated that this downward vertical movement of sled 14 relative to carriage 22 results from forces imparted on sled 14 by the slight leftward movement of carriage 22 as second follower members 12*a* of chassis 12 urge sled 14 downwardly via an upwardly and rightwardly inclined, left-most region of first cam surfaces 14*a* of chassis 12**.

Figure 2C:
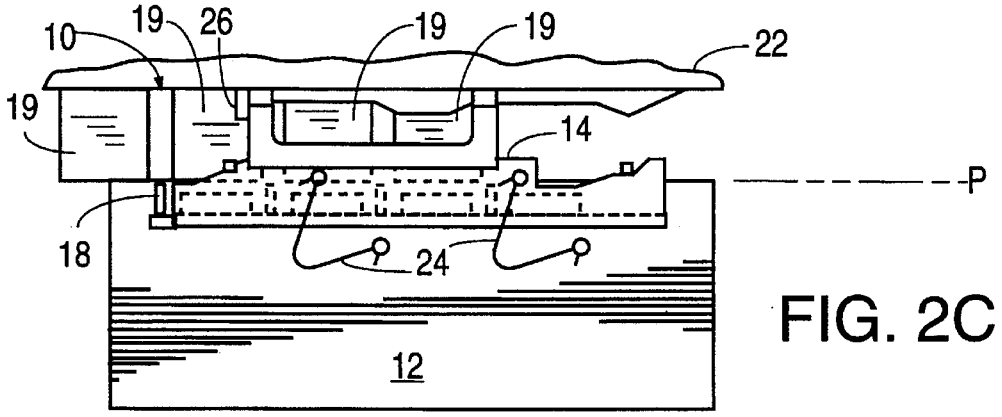
Figure 2D:
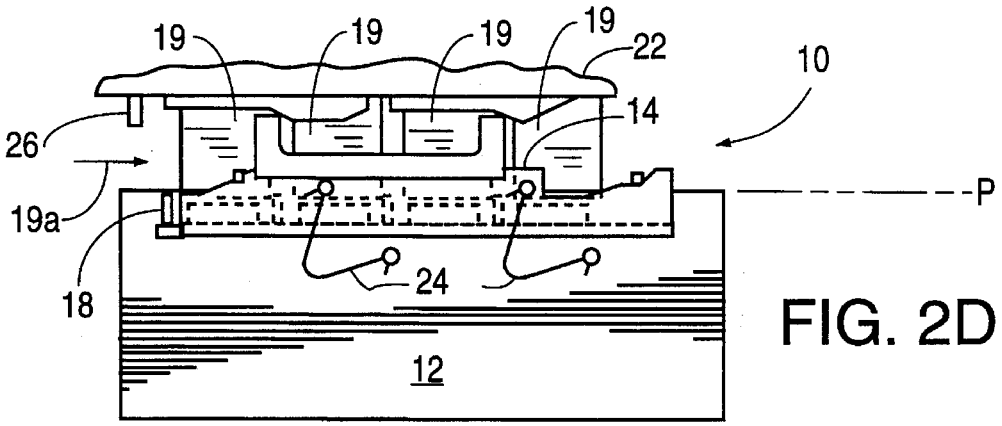

Now contrasting FIGS. 2B and 2C, it may be understood how sled 14 has moved from its uncapped position of FIG. 2B to its start wipe position of FIG. 2C. In FIG. 2C, carriage 12 is slightly further to the left than in FIG. 2B, but it is primarily lesser tension in spring elements 24 (i.e., the fact that spring elements 24 were compressed in the uncapped position of FIG. 2B into a higher energy state) that causes sled 14 to move slightly further left relative to chassis 12 such that second follower members 12*a* thereof reach a temporary stop, indicated as S, approximately half way up inclined first cam surfaces 14*a*. FIGS. 2C and 2D accordingly represent what may be referred to as an equilibrium position of sled 14 relative to chassis 12 in which sled 14 will remain at a predefined wiping elevation relative to carriage 22 until it is urged out of equilibrium by an external force. Accordingly, FIG. 2C represents a start-of-wipe, or begin-wipe, position, and FIG. 2D represents an end-of-wipe position between which the printheads 19 are wiped by substantially horizontal relative movement between carriage 22 and chassis 12. Printheads 19 as set forth above, are mounted on movable carriage 22 and the wipers are mounted on a planar support member 20 on sled 14 (FIG. 2A).

Figure 2E:
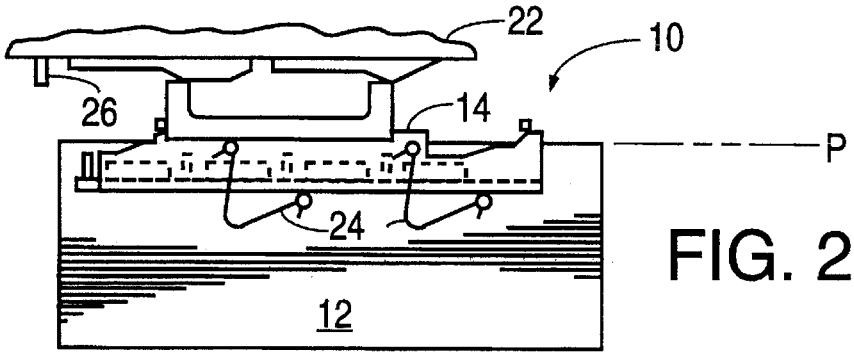

Contrasting now FIGS. 2D and 2E, it may be seen that, at the end of the wiping action in which sled 14 is in the above described equilibrium position, second cam surfaces 22*a*, 22*b* of carriage 22 impact upon first follower members 14*b* of sled 14 to force sled 14 slightly downwardly near the end of the leftward travel of carriage 22. FIG. 2E illustrates a position of sled 14 at which wipers 18 have disengaged from the printheads.

Figure 2F:
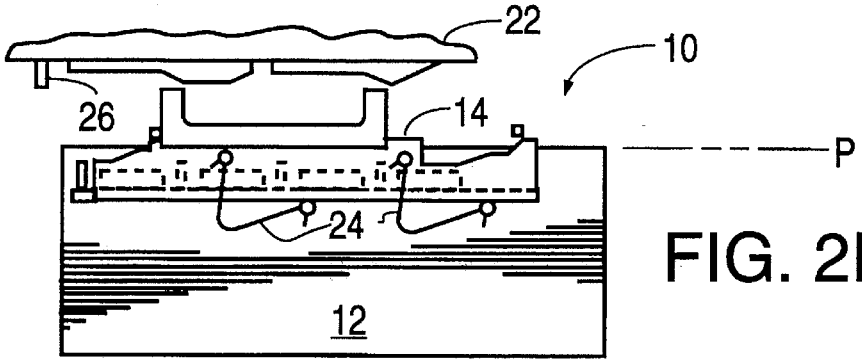

FIG. 2F shows the down position of sled 14 in which carriage 22, freely and without printhead interference with either caps 16 or wipers 18, may be horizontally reciprocated above sled 14.

Figure 2G:
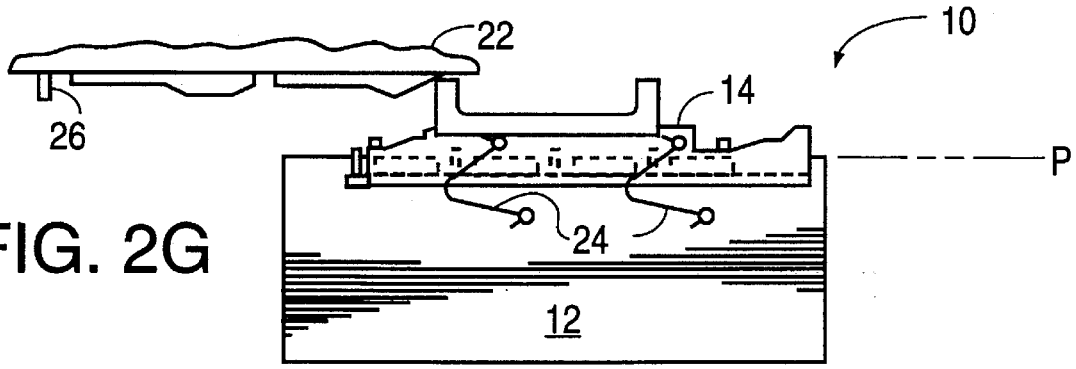
Figure 2H:
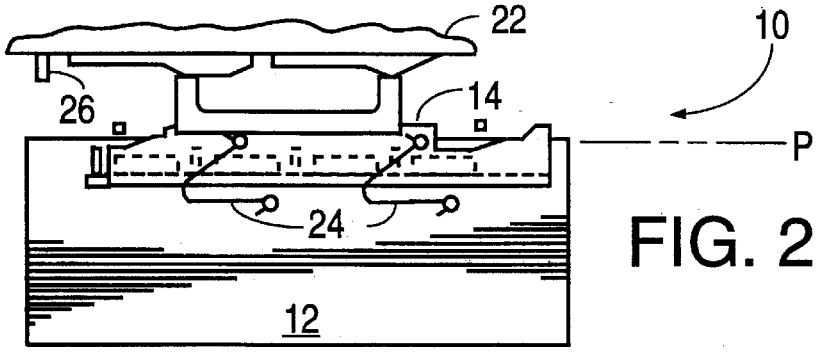

FIG. 2G shows a temporary lockout position of carriage 22 that might be reached by intentional or inadvertent manual intervention by a printer operator or service person. Importantly, second cam surface 22*b* on its extreme right end has a leftwardly, downwardly inclined region that, with first cam follower members 14*b* positioned to the right thereof but moving toward the left, causes sled 14 to settle into a lowered position in which carriage 22 freely may be returned to the right as in the capping position shown in FIG. 2A. It will be understood that spring elements 24 under compression in the position of sled 14 shown in FIG. 2H tend to urge sled 14 into its elevated, printhead-capping position of FIG. 2A as carriage 22 travels toward the right.

Briefly summarizing, it may be seen that relative movement between carriage 22 and base 12 produces downward movement of sled 14 by cam action between first cam surface 14*a* and second follower member 12*a*, the extent of which downward movement is predefined to position the upper terminal ends of wipers 18 in first plane P defined by the lower surfaces of the printheads 19, thereby to define a wiping position of sled 14. Further relative movement between carriage 22 and base 12 produces wiping action between wipers 18 and the printheads 19. Still further relative movement therebetween produces further downward movement of sled 14 by cam action between second cam surface 22*a* and first follower member 14*b*, the extent of which is predefined to position the lips of caps 16 and the upper terminal ends of wipers 18 beneath first plane P, thereby defining a free position of sled 14 in which carriage 22 mounting the printheads freely may be reciprocated without interference between the printheads and the lips or between the printheads and the wipers.

Figure 4:
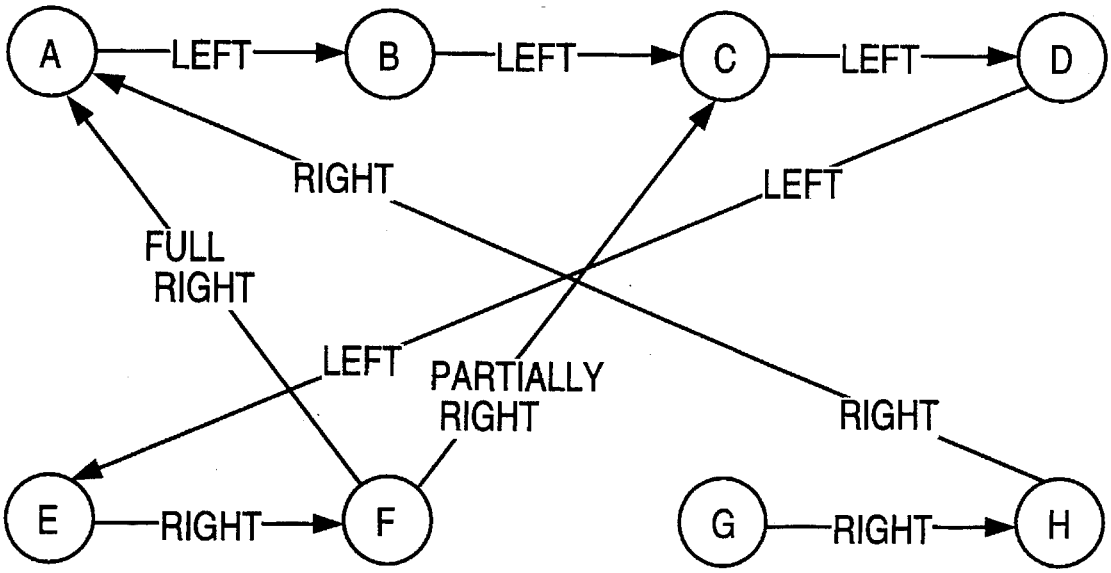
FIG. 4 is a transition diagram corresponding with the operational phases illustrated in FIGS. 2A through 2H.

FIG. 4 is a flow diagram that illustrates the transitions (represented by arrows labelled with the direction of travel of carriage 22 that produces the transition) through which printer 10 progresses to reach the various operational phases A through H (represented by circles so labelled) corresponding, respectively, with FIGS. 2A through 2H. FIG. 4 is thought to be self-explanatory, to those skilled in the art having an understanding of FIGS. 2A through 2H, as described herein. It may be seen from FIG. 4 that the capped or capping position (A) of sled 14 represents the start of the service mode of operation of the inkjet printer 10 to which the sled 14 may be returned from its down position (F) that normally ends such service mode. Alternatively, when sled 14 is in its down position, it may repeatedly wipe the printheads 19 by transitioning instead to its start-wipe position (C) and indefinitely repeating transitioning through its start-wipe (C), end-wipe (D), disengage-wipe (E) and down (F) positions, as shown.

In the event that the service mode of operation of the printer 10 is manually locked out (G), nevertheless such is only temporary in that sled 14 may be moved to its service position by transitioning through an entering-from-lock-out position (H) by moving carriage 22 to the right as shown. First follower members 14*b* glide along leftwardly, downwardly inclined regions of second cam surfaces 22*a*, 22*b* to return sled 14 to the capped position (A). (It is noted in this connection that the left one of cam follower members 14*b* is made slightly wider than the right one, and that the spaces immediately to the left and right of second cam surface 22*a* also are differently dimensioned, so that left cam follower member 14*b* cannot enter the space between second cam surfaces 22*a*, 22*b* during a transition from the entering-from-lock-out position (H) to the capping position (A).)

It will be appreciated that it is the full or partway extent of rightward carriage travel, as determined by the controller, that determines whether sled 14 transitions from its down position (F) to its capping position (A) or to its start-wipe position (C). In other words, carriage 22 is positioned either a first predefined extent of movement after first follower member 14*b* hits end stop 26 in order to place sled 14 in its capping position (A), or a second predefined extent of movement less than the first predefined extent of movement after first follower member 14*b* hits end stop 26, to place sled 14 in its start-wipe position (C).

Skilled persons will appreciate that carriage-mounted end stop member 26 engages first follower member 14*b* to urge sled 14 laterally relative to base 12, in response to rightward movement of carriage 12 by the controller. Thus, with sled 14 in its free position in which carriage 22 freely may be reciprocated thereabove, e.g., its down position (F), and with such first predefined extent of movement by carriage 22, stop member 26 stops first follower member 14*b* thereby producing movement between first cam surface 14*a* and second follower member 12*a* sufficient to elevate sled 14 to a capping position (A) of caps 16 relative to the printheads. Alternatively, with sled 14 in such free position and with such second predefined extent of movement, stop member 26 stops follower member 14*b* thereby producing movement between cam surface 14*a* and follower member 12*a* sufficient only to elevate sled 14 to a start-wipe position (C), or simply a wiping position or elevation, of wipers 18 relative to the printheads.

The method of the invention now may be understood, in view of the above description of an apparatus according to the invention. The method of uncapping and wiping an inkjet printer's printhead, wherein the printhead is fixedly mounted on a movable carriage of the printer, includes: (1) providing a sled-mounted wiper selectively engageable with the printhead, e.g., wiper 18 mounted on sled 14; (2)

providing the sled with a cam surface, e.g., surface 14*a*, for engaging a corresponding cam follower member, e.g., member 12*a*, mounted on the printer's chassis; (3) spring-mounting such sled on such chassis, e.g., by way of spring elements 24; (4) first moving the carriage horizontally relative to such chassis, thereby producing vertical movement between the sled and the carriage by cam action to uncap the printhead and to position the wiper in a plane defined by the printhead, e.g., controlling the movement of carriage 22 to cause sled 14 and wiper 18 mounted thereon to leave its capping position (A) and to move to its uncapped position (B); (5) second moving the carriage horizontally relative to the chassis, thereby producing horizontal movement of the sled parallel with such plane in such manner that the printhead 19 is wiped by the wiper in a given direction defined by such relative movement, e.g., controlling the movement of carriage 22 from its start-wipe position (C) to its end-of-wipe position (D) to cause sled-mounted wiper 18 to wipe the printhead 19 in the illustrated left-to-right direction; and thereafter (6) lowering the sled to position the wiper below such plane, e.g., into the illustrated down position (F).

The method further includes, after the lowering step, (7) third moving the carriage horizontally relative to the chassis to restore the printhead to a capped position, e.g., moving carriage 22 fully to the right such that left follower member 14*b* impacts on stop member 26 to force the sled 14 back into its capped position (A). Optionally, the method may include repeating the second moving step, as illustrated best in FIG. 4 by the directed arrows to operational phases labelled C, D, E, F, C, D, E, F, etc.

While the above method is described as involving the uncapping, capping and optional recapping of a singular printhead, it will be appreciated that, in accordance with the apparatus according to the invention, the printer may have plural printheads and plural corresponding wipers, whereby all printheads are uncapped, wiped and capped also in accordance with the method of the invention. It will be appreciated that the invented method and apparatus are compatible with printhead spitting, simultaneously with or closely proximate in time with, wiping. It also will be appreciated that the invented method and apparatus are compatible with printhead priming, performed in accordance with the above-referenced automatic failure recovery patent application.

It may be seen, then, that the invented wiping and capping method and apparatus for inkjet printers enables automatic servicing of the inkjet's printheads, providing uni-directional wiping of each printhead by a separate wiper to avoid printhead re-contamination or inter-printhead contamination. Printhead capping, which greatly extends the life of an inkjet printer, is done under constant force on, rather than under constant deflection of, the caps' sealing lips. Few, relatively simple parts are required and provide a relatively low-cost service solution, while avoiding the cost of additional drive motors. This is made possible by gimbal mounting the sled, which, in turn, mounts the caps and wipers, to the printer's chassis and by variously positioning the sled by dual cam action between the sled and the chassis, and between the sled and the carriage. Controlled reciprocal, horizontal movement of the printer's carriage sequences the sled through its various positions to uncap, wipe, (repeatedly, as needed) and recap the printheads. The invented wiping and capping method require no operator intervention, take the printer off-line for only a second, and automatically restore the printer from its service mode to its printing mode of operation.

FIG. 5 is an exploded perspective view of a service station 500 for use with an inkjet printer according to the invention illustrating the assembly of the service station 500. Springs 502 are mounted within a hole formed in printer chassis 501. (For clarity, only a portion of printer chassis 501 is shown in FIG. 5.) Sled 503 is mounted on springs 502 such that sled 503 is positioned partially within the hole formed in the printer chassis 501. Cam holder 504 is secured to printer chassis 501 over sled 503, pressing sled 503 down so that springs 502 are compressed.

As described above, a print carriage (not shown) is cam-coupled to sled 503. Additionally, cam coupler 504 (considered part of chassis 12 in the description of FIGS. 2A through 2H) is cam-coupled to sled 503. This dual cam-coupling operates as described above with respect to FIGS. 2A through 2H, 3 and 4 to move sled 503 vertically and horizontally to one of three positions in response to movement of the print carriage. In the capped position, sled 503 is moved laterally as far as possible to the right and out of the plane of FIG. 5, so that sled 503 is raised to its highest position. In the print position, when the carriage is free to move without contacting any part of sled 503, sled 503 is moved laterally as far as possible to the left and into the plane of FIG. 5, so that sled 503 is lowered to its lowest position. In the wiping position, sled 503 is intermediate between the capped and print positions, both laterally and vertically.

Each of springs 502 is made of a material and shaped so that springs 502 have a desired spring constant, k, such that sled 503 is biased against cam holder 504 by a force of a desired magnitude and such that, during operation of the printer including service station 500, the vibrations of sled 503 are maintained below a desired magnitude. Illustratively, springs 502 are made of a metal such as steel. Illustratively, springs 502 are made so that the spring constant of springs 502 yields approximately 0.4 pounds of force (1.8 N) when springs 502 are compressed in the capping position. Generally, the force imparted by springs 502 is of a magnitude sufficient to ensure that sled 503 is held securely in place while in any of the three sled positions: capping position, wiping position, and position that allows free movement of the print carriage.

FIG. 6 is a perspective view of one of springs 502. Spring 502 are wire springs including two substantially parallel V-shaped sections 502*a* connected at the end of one leg of each of the V-shapes by connecting section 502*b*. The nominal angle between the legs of each of the V-shaped sections 502*a* is 36°. The end of the other leg of each of the V-shapes is formed into a looped section 502*c*.

Returning to FIG. 5, each spring 502 is mounted within the hole in printer chassis 501 by fitting looped sections 502*c* formed on opposing ends of each spring 502 around corresponding protrusions 501*a* formed on opposing walls of the hole in printer chassis 501. Each spring 502 is oriented so that the leg of the V-shape connected to connecting section 502*a* is above the looped sections 502*c*. Sled 503 is then mounted on springs 502 by fitting the connecting section 502*a* of each spring 502 into a corresponding slot formed in the bottom of sled 503.

Figure 7A:
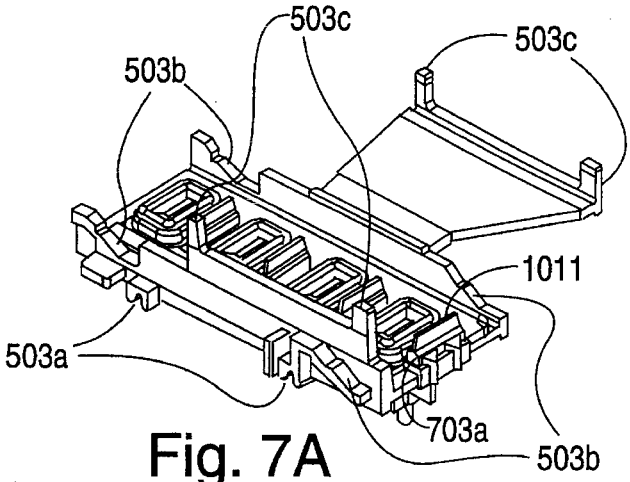
FIG. 7A is a perspective view of the sled of the service station of FIG. 5, upper edge.

FIG. 7A is a perspective view of sled 503 of service station 500 of FIG. 5A. As described above, connecting sections 502*a* of springs 502 are fitted into slots 503*a*. Sled 503 includes sled cam surfaces 503*b*. Sled cam surfaces 503*b* correspond to cam surfaces 14*a* of FIG. 3. Sled 503 also includes sled cam follower extensions 503*c* and a longitudinal axis 503*d*. Sled cam follower extensions 503*c* correspond to first cam follower members 14*b* of FIG. 3.

Figure 7B:
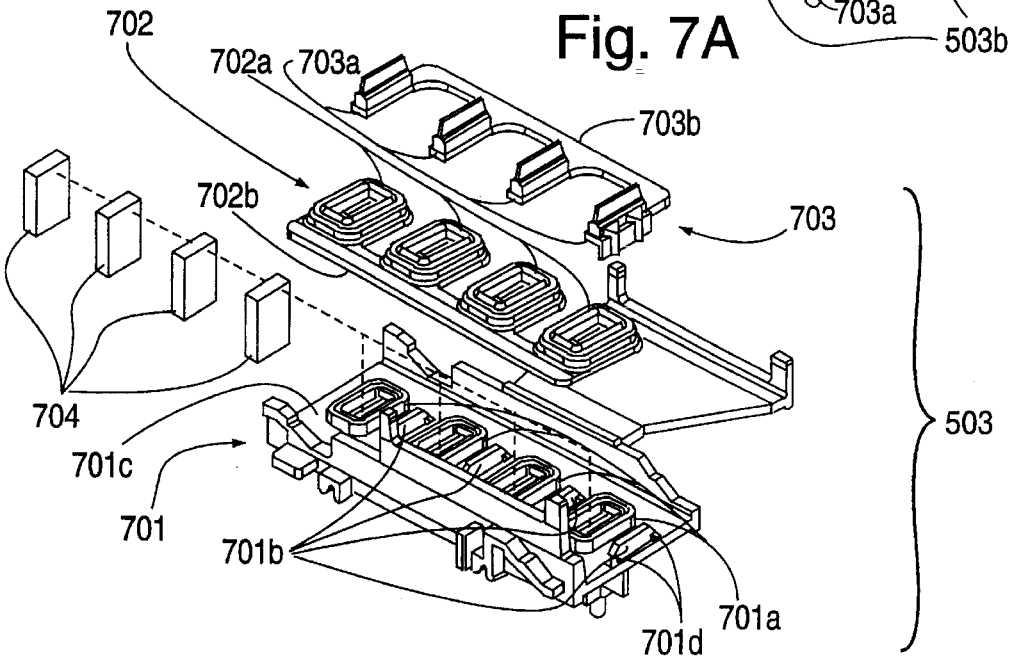
FIG. 7B is an exploded perspective view of the sled of FIG. 7A illustrating the assembly of the sled.

FIG. 7B is an exploded perspective view of sled 503 illustrating the assembly of sled 503. Sled 503 includes sled body 701, cap structure 702, wiper structure 703 and filters 704. Cap structure 702 includes four caps 702*a* connected by a cap connecting bar 702*b* to form an integral structure. Cap structure 702 is made of, for instance, rubber. In one embodiment, cap structure 702 is EPDM rubber having a hardness between durometer 40–66 Shore A with a tolerance of 5 Shore. Other materials could be used, e.g., rubber-like plastics such as polyurethane, kraton or terathane. Likewise, wiper structure 703 includes four wipers 703*a* connected by a wiper connecting bar 703*b* to form an integral structure. Wiper structure 703 is preferably made of polyurethane, for reasons discussed more fully below, though another material, such as EPDM rubber, could be used.

Caps 702*a* of cap structure 702 are stretched slightly and fitted over corresponding cap mounts 701*a* formed on upper surface 701*c* of sled body 701. Cap structure 702 is held in place by the friction fit between each cap 702*a* and cap mount 701*b*. Likewise, wipers 703*b* of wiper structure 703 are fitted over substantially coextensive wiper mounts 701*a* formed on and protruding from upper surface 701*c* of sled body 701 and held in place by a friction fit. Cap mounts 701*a* are formed alternately with wiper mounts 701*b* in a line. Consequently, when cap structure 702 and wiper structure 703 are mounted on sled body 701, a row of caps 702*a* and wipers 703*a* is formed, the caps 702*a* and wipers 703*a* located in alternating positions. Since cap structure 702 and wiper structure 703 do not overlap, either cap structure 702 or wiper structure 703 can be mounted first on sled body 701, or both can be mounted simultaneously.

One of filters 704 is placed in a cavity formed below each cap mount 701*a*. Filters 704 are retained in the cavity by the walls of the cavity and the corresponding cap 702*a*. Filters 704 absorb ink during priming of the print cartridges so that the tubing to the primer, explained in more detail below, does not become clogged with ink.

Stress is imparted to wipers 703*a* when wipers 703*a* contact the corresponding printheads. In order to adequately wipe the printheads, wipers 703*a* must be relatively stiff.

FIGS. 8A–8F are a top perspective view, bottom perspective view, top view, side cross-sectional view, bottom view and side view, respectively, of wiper structure 703. As previously described, wiper structure 703 includes four wipers 703*a* connected by a wiper connecting bar 703*b* to form an integral structure. FIGS. 8G and 8H are cross-sectional views, taken along section line A—A of FIG. 8C and section line B—B of FIG. 8D, respectively, illustrating an individual wiper 703*a*. FIG. 8I is a detailed bottom view of an individual wiper 703*a* of FIG. 8E.

Figure 8A:
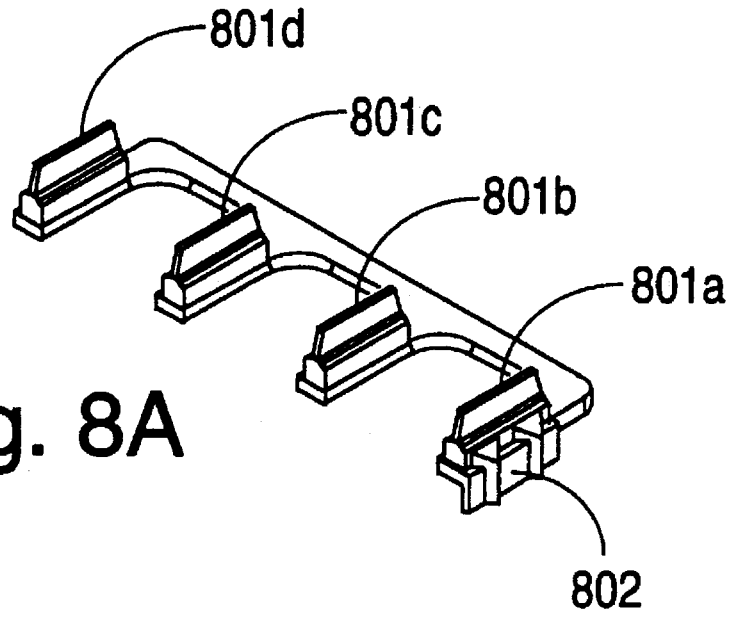
FIGS. 8A–8F are a top perspective view, bottom perspective view, top view, side cross-sectional view, bottom view and side view, respectively, of an integral wiper structure for use with a service station according to the invention.

As seen in FIG. 8A, bumper 802 is formed on one of wipers 703*a*. As explained in more detail below, bumper 802 helps reduce the noise associated with operation of service station 500.

Figure 8B:
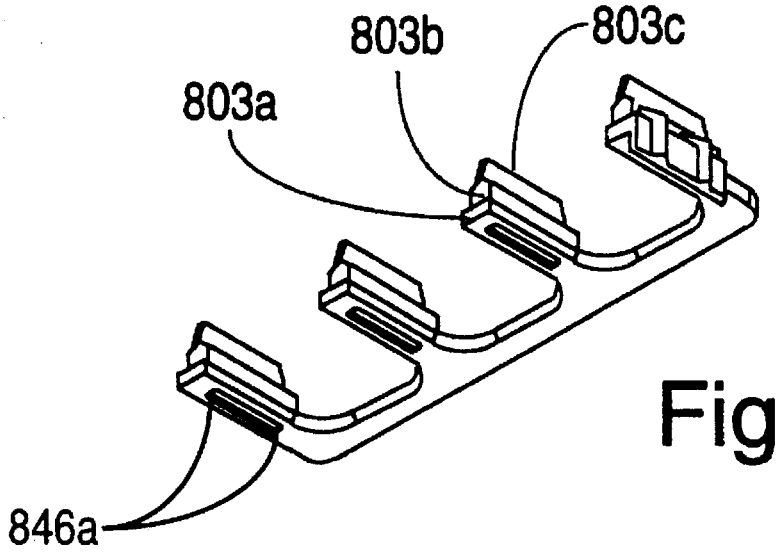

As shown in FIG. 8B, each wiper 703*a* is formed of three sections: base section 803*a*, intermediate section 803*b*, and blade section 803*c*. Rather than being mounted underneath upper surface 701*c* of sled body 701 and extending through holes formed through upper surface 701*c*, as in the prior art, base section 803*a* is mounted on upper surface 701*c*. As a result, wipers 703*a* are shorter and, therefore, stiffer than the prior art wipers.

Additionally, the tripartite structure of each wiper 703*a* improves the stiffness of wipers 703*a*. As particularly seen in FIG. 8D, the width of each of the sections 803*a*, 803*b*, 803*c* increases moving from blade section 803*c* to base section 803*a*. Because of the relative thickness at the bottom of wiper 703*a*, the stiffness of wiper 703*a* is increased and wiping is improved. In particular, the combination of mounting base section 803*a* of wipers 703*a* on upper surface 701*c* and increasing the thickness of wipers 703*a* from blade section 803*c* to base section 803*a* provides increased stiffness of wipers 703*a*, and, therefore, better wiping.

Figure 7C:
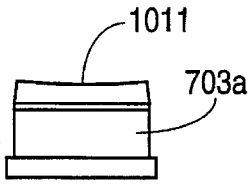
FIG. 7C is a magnified side view of a wiper mounted on a sled.

The opposing ends of blade section 803*c* of each wiper 703*a* are relatively less stiff than the middle of blade section 803*c*. In sled body 701, an undercut 701*d* is formed in each of wiper mounts 701*b* at each opposite end of the mount near upper surface 701*c* so that the relatively elastic material of wiper structure 703 deforms around wiper mounts 701*b*, thereby retaining wiper structure 703. When mounted on wiper mounts 701*b*, wipers 703*a* deform so that the upper edge, which is the wiping edge, of each of wipers 703*a* becomes concave. This concavity imparts added stiffness to the ends of blade section 803*c*, thereby improving the wiping performance of wipers 703*a*. This concavity 1011 is shown in magnified side view in FIG. 7C.

Additionally, the ends of blade section 803*c* are chamfered. The chamfer removes wiper 703*a* material from the upper end corners of blade section 803*c*, a region of low stiffness relative to the remainder of blade section 803*c*. As a result, the stiffness of blade section 803*c* is made more consistent across blade section 803*c*, thereby improving wiping.

Figure 8C:
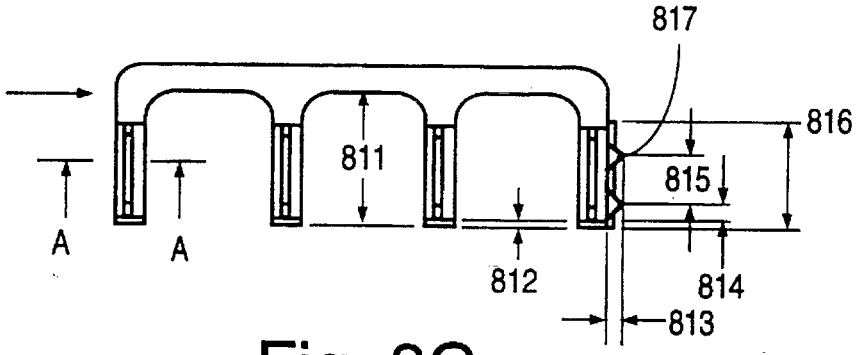

Below, illustrative dimensions are given for wiping structure 703 with respect to FIGS. 8A–8I. In FIG. 8C, distance 811 between the inner edge of wiper connecting bar 703*b* and the distal end of intermediate section 803*b* is 18.9 mm (0.744 inches). Distance 812 between the ends of intermediate section 803*b* and base section 803*a* distal from inner edge of wiper connecting bar 703*b* is 0.5 mm (0.02 inches). Distance 813 from the base to the peaks of bumper 802 is 2.40 mm (94.5 mils). Distance 814 from the peak of bumper 802 to the end of intermediate section 803*b* distal from the inner edge of wiper connecting bar 703*b* is 3.4 mm (0.13 inches). Distance 815 between peaks of bumper 802 is 7.2 mm (0.28 inches). Length 816 of the extending portion of bumper 802 is 15.0 mm (0.591 inches). Sides 817 of the bumper peaks are beveled at a 45° angle.

Figure 8D:
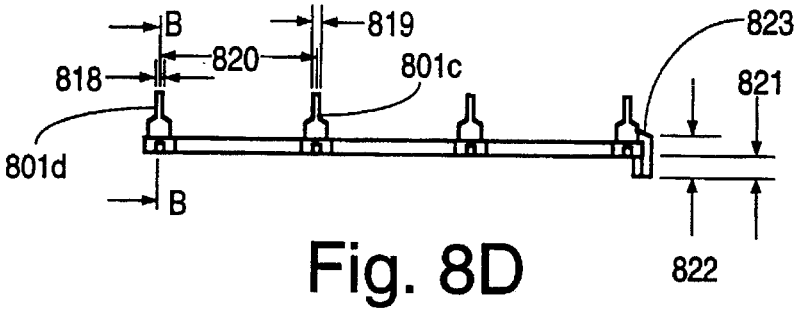

In FIG. 8D, thickness 818 of blade section 803*c* of wiper 801*d* is 0.98 mm (0.039 inches). Thickness 819 of blade section 803*c* of wiper 801*c* (as well as wipers 801*a* and 801*b*) is 0.76 mm (0.030 inches). The blade section 803*c* of wiper 801*d* is made thicker than that of the other wipers 801*a*, 801*b* and 801*c* (FIG. 8A) for a reason explained below. Center-to-center distance 820 between adjacent wipers 702*a* is 23.24 mm (0.9150 inches). Length 821 from the end of the extending portion of bumper 802 to the base of wiper structure 702 is 3.0 mm (0.12 inches). Height 822 of the extending portion of bumper 802 is 5.6 mm (0.22 inches). Side 823 of bumper 802 is beveled at a 30° angle.

Figure 8E:
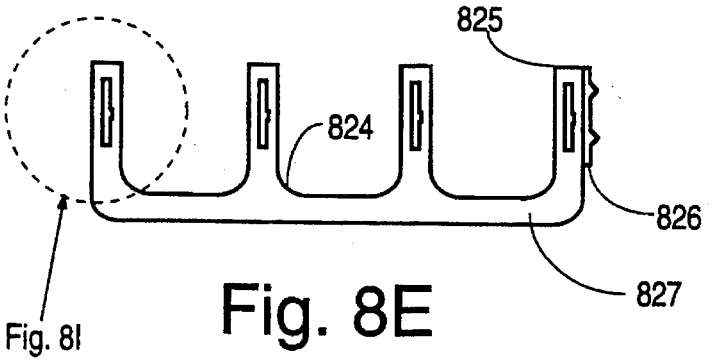

In FIG. 8E, radius 824 is 5 mm (0.2 inches). Radius 825 is 0.2 mm (8 mils). Radius 826 is 0.2 mm (8 mils). Radius 827 is 3 mm (0.1 inches).

Figure 8F:
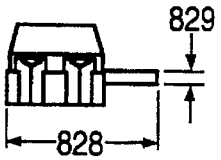
Figure 8G:
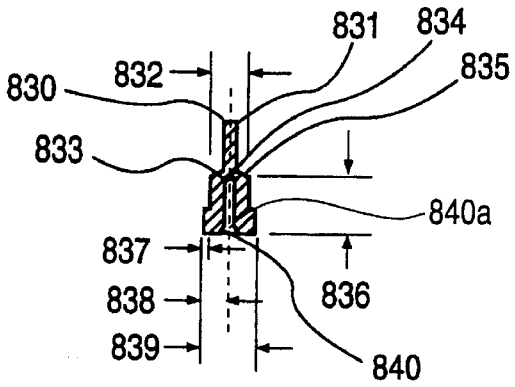
FIGS. 8G and 8H are cross-sectional views, taken along section line A—A of FIG. 8C and section line B—B of FIG. 8D, respectively, illustrating an individual wiper of the wiper structure of FIGS. 8A–8F.
Figure 8H:
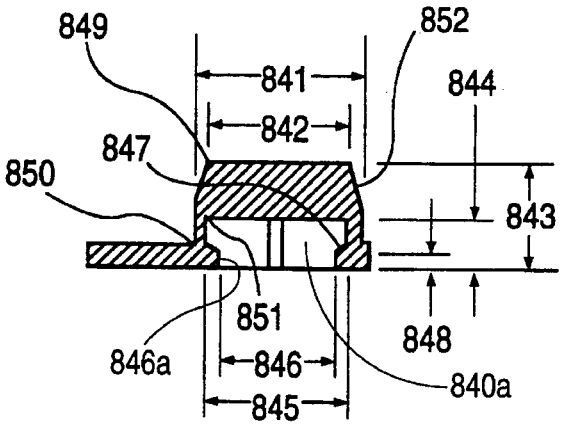
Figure 8I:
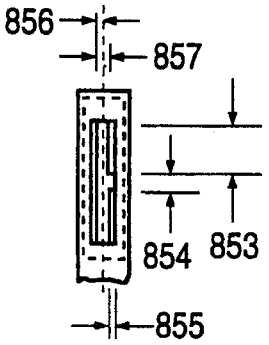
FIG. 8I is a detailed bottom view of an individual wiper of the wiper structure of FIGS. 8A–8F.

In FIG. 8F, length 828 of wiper structure 703 is 23.4 mm (0.921 inches). Thickness 829 of wiper connecting bar 703*b* is 2.0 mm (0.079 inches).

FIG. 8G is a cross-sectional view of a wiper 703*a*. Radius 830 is eliminated, if possible, but is no more than 0.05 mm (2 mils). Radius 831 is eliminated, if possible, but is no more than 0.2 mm (8 mils). Thickness 832 of intermediate section 803*b* is 3.4 mm (0.13 inches). Radius 833 is 0.2 mm (8 mils). Radius 834 is 0.8 mm (0.03 inches). Side 835 of intermediate section 803*b* is beveled at 30°. Distance 836 from beveled side 835 to the base of base section 803*a* is 4.5 mm (0.18 inches). Distance 837 from the edge of base section 803*a* to the edge of intermediate section 803*b* is 0.5 mm (0.02 inches). Distance 838 from the centerline of wiper 703*a* to the edge of intermediate section 803*b* is 2.2 mm (0.087 inches). Thickness 839 of base section 803*a* is 4.4 mm (0.17 inches). Interior corner 840 of the cavity 840*a* in wiper 703*a* is beveled at 45°.

In FIG. 8H, length 841 of intermediate section 803*b* is 14.0 mm (0.551 inches). Length 842 of the top of blade section 803*c* is 12.00 mm (0.4724 inches) and is symmetrically placed with respect to length 841. Height 843 of wiper 703*a* is 9.00 mm (0.354 inches). Height 844 of the cavity within wiper 703*a* is 4.5 mm (0.177 inches). Inner length 845 of the cavity within wiper 703*a* is 12.00 mm (0.4724 inches); outer length 846 is 10.00 mm (0.3937 inches) and is symmetrically placed with respect to inner length 845. Further, both of lengths 845 and 846 are symmetrically placed with respect to intermediate section 803*b* and blade section 803*c* forming an inwardly extending wiper lip 846*a* at the entrance to the wiper cavity. Upon mounting the wiper cavity on the wiper mount 701*b* the wiper lip 846*a* frictionally fits into the undercut 701*d* (FIG. 7*b*). Radius 847 is 1.0 mm (0.039 inches) and forms inwardly extending wiper lips 846*a* which extend into respective ones of the undercuts 701*d* shown in FIG. 7B. Distance 848 from the beginning of radius 847 to the base of wiper 703*a* is 2.0 mm (0.079 inches). Radius 849 is eliminated, if possible, but is no more than 0.3 mm (12 mils). Radius 850 is 0.2 mm (8 mils). Radius 851 is 0.2 mm (8 mils). Side 852 of blade section 803*c* is beveled at 15°.

In FIG. 8I, dimension 853 is 4.4 mm (0.17 inches). Dimension 854 is 1.2 mm (0.047 inches). Dimension 855 is 0.3 mm (12 mils). Dimension 856 is 0.50 mm (20 mils). Dimension 857 is 1.00 mm (39.4 mils).

Though other numbers of print cartridges and other ink colors can be used, in the description above, four print cartridges are used, each print cartridge containing one of four ink colors: black, cyan, magenta and yellow. In FIG. 8A, the print cartridges are arranged so that wiper 801*a* is used to wipe the yellow print cartridge, wiper 801*b* is used to wipe the magenta print cartridge, wiper 801*c* is used to wipe the cyan print cartridge and wiper 801*d* is used to wipe the black print cartridge.

Black ink is formed with pigment rather than the dye used in color inks. Since the pigment does not dissolve as the dyes do, the nozzles of black ink print cartridges are more susceptible to ink crusting than the nozzles of color print cartridges. Consequently, it is desirable that the wiper used to wipe the black ink print cartridge printhead be more robust than the wipers used to wipe color ink cartridge printheads. Therefore, as described above with respect to FIG. 8D, blade section 803*c* of wiper 801*d* is made thicker than blade sections 803*c* of wipers 801*a*, 801*b* and 801*c* so that wiper 801*d* will be stiffer than wipers 801*a*, 801*b* and 801*c*, thus providing better wiping where it is needed most, i.e., on the black print cartridge.

It is to be understood that other arrangements of the ink colors could be used and that other numbers of print cartridges (thus necessitating another number of wipers) could also be used. In that case, whichever wiper corresponds to the black ink cartridge (or any other cartridge that requires strong wiping) is made thicker than the other wipers. Further, according to the invention, it is not necessary that the black ink wiper be made thicker; in other embodiments of the invention, all wipers have the same thickness.

Figure 9A:
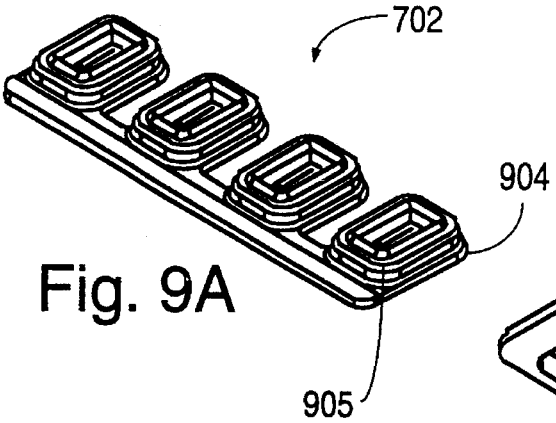
FIGS. 9A–9F are a top perspective view, bottom perspective view, top view, side cross-sectional view, bottom view and side view, respectively, of an integral cap structure for use with a service station according to the invention.
Figure 9B:
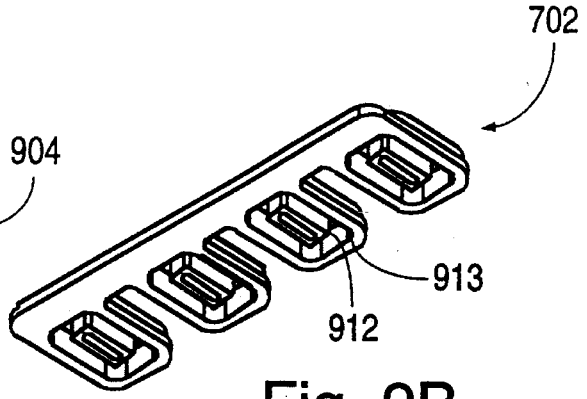
Figure 9C:
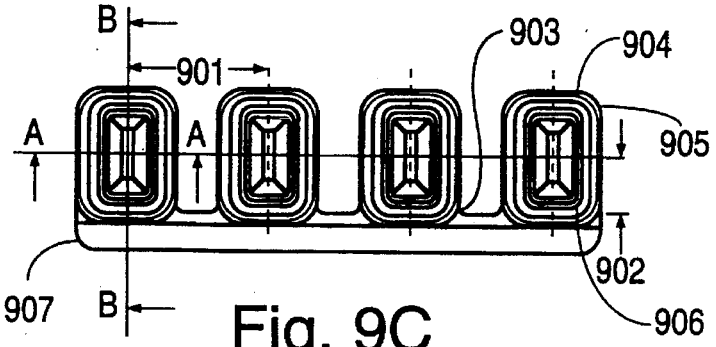

FIGS. 9A–9F are a top perspective view, bottom perspective view, top view, side cross-sectional view, bottom view and side view, respectively, of integral cap structure 702. As previously described, cap structure 702 includes four caps 702*a* connected by a cap connecting bar 702*b* to form an integral structure. FIGS. 9G and 9H are cross-sectional views, taken along sections line B—B and A—A, respectively, of FIG. 9C illustrating an individual cap 702*a*. FIG. 9I is a detailed cross-sectional view showing a portion of the cross-sectional view of FIG. 9H. Illustrative dimensions are given for cap structure 702 with respect to FIGS. 9A–9I.

In FIG. 9C, center-to-center distance 901 between adjacent caps 702*a* is 23.24 mm (0.9150 inches). Distance 902 between the center of each cap 702*a* and the inner edge of cap connecting bar 702*b* is 9.2 mm (0.36 inches). Radius 903 is 1.0 mm (0.39 inches). Radius 904 is 5.3 mm (0.21 inches). Radius 905 is 4.3 mm (0.17 inches). Radius 906 is 1.0 mm (0.039 inches). Radius 907 is 3.0 mm (0.12 inches).

Figure 9D:
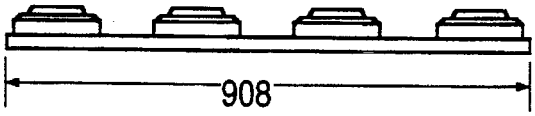

In FIG. 9D, width 908 of cap structure 702 is 86.0 mm (3.39 inches).

Figure 9E:
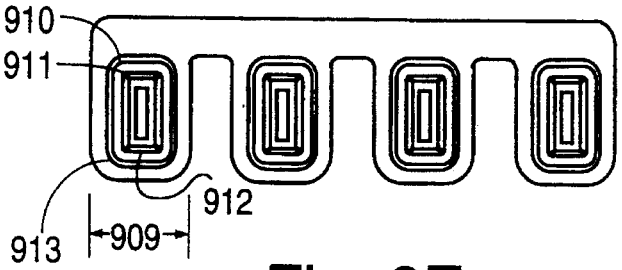

In FIG. 9E, width 909 of each cap 702*a* is 16.3 mm (0.642 inches). Radius 910 is 2.0 mm (0.079 inches). Radius 911 is 0.3 mm (12 mils). Radius 912 is 0.5 mm (20 mils). Radius 913 is 2.8 mm (0.11 inches).

Figure 9F:
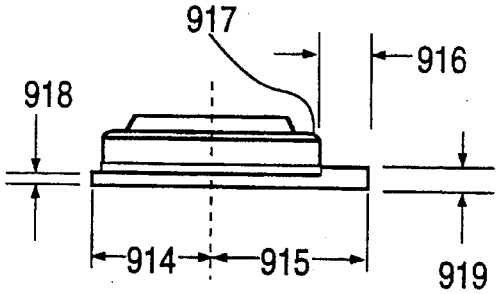
Figure 9G:
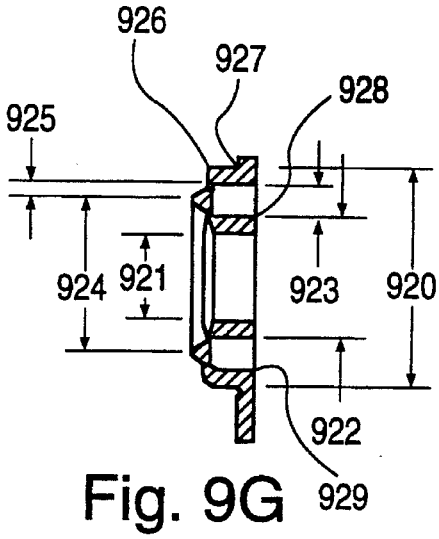
FIGS. 9G and 9H are cross-sectional views, taken along sections line B—B and A—A, respectively, of FIG. 9C illustrating an individual cap of the cap structure of FIGS. 9A–9F.
Figure 9H:
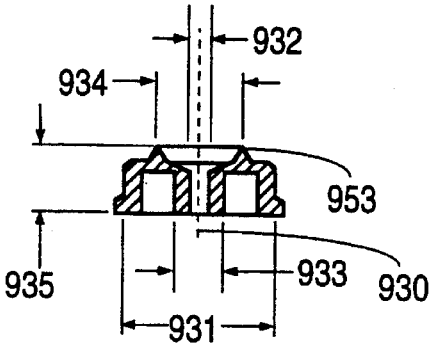
Figure 9I:
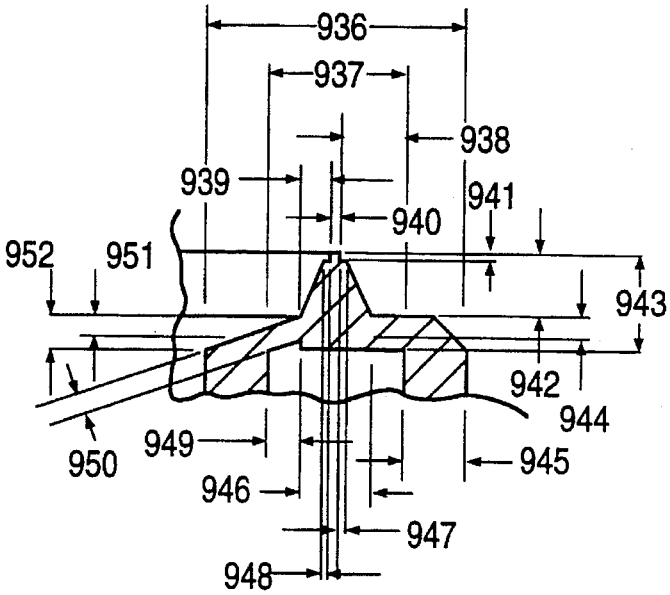
FIG. 9I is a detailed cross-sectional view showing a portion of the cross-sectional view of FIG. 9H.

In FIG. 9F, distance 914 from the center of each cap 702*a* to the end of cap 702*a* opposite the end of cap 702*a* that is integrated with cap connecting bar 702*b* is 11.4 mm (0.449 inches). Distance 915 from the center of each cap 702*a* to the outer edge of cap connecting bar 702*b* is 15.4 mm (0.606 inches). Distance 916 from the outer edge of cap connecting bar 702*b* to the beginning of each cap structure 702*a* is 4.0 mm (0.16 inches). Edge 917 of each cap 702*a* is beveled at 45°. Thickness 918 from the base of cap structure 702 to the base of each cap 702*a* is 1.5 mm (0.059 inches). Thickness 919 of cap connecting bar 702*b* is 2.0 mm (0.079 inches).

In FIG. 9G, length 920 of the elevated portion of each cap 702*a* is 20.75 mm (0.8169 inches). Length 921 of the hole formed in each cap 702*a* is 8.25 mm (0.325 inches). Length 922 of the interior protruding portion of each cap 702*a* is 11.25 mm (0.4429 inches). Length 923 of the gap between the interior protruding portion and the exterior portion of each cap 702*a* is 3.25 mm (0.128 inches). Length 924 between the peaks of the peaked portions of each cap 702*a* is 14.75 mm (0.5807 inches). Length 925 from the peak to the base of each peaked portion is 1.5 mm (0.059 inches). Chamfer 926 is 0.75 mm (30 mils) by 45°. Chamfer 927 is 0.5 mm (20 mils) by 45°. Chamfer 928 is 0.25 mm (9.8 mils) by 45°. Chamfer 929 is 0.25 mm (9.8 mils) by 45°.

In FIG. 9H, the structure of the cap 702*a* is symmetrical about the centerline 930 of the cap 702*a*. Width 931 of the elevated portion of each cap 702*a* is 14.25 mm (0.5610 inches). Width 932 of the hole formed in each cap 702*a* is 1.75 mm (0.0689 inches). Width 933 of the interior protruding portion of each cap 702*a* is 4.75 mm (0.187 inches). Width 934 between the peaked portions on the top of each cap 702*a* is 8.25 mm (0.325 inches). Height 935 from the base of cap structure 702 to the peak of the peaked portion of each cap 702*a* is 6.50 mm (0.256 inches).

FIG. 9I is a detailed view of a portion of FIG. 9H showing illustrative dimensions in the vicinity of a peaked portion of each cap 702*a*. Dimension 936 is 6.25 mm (0.246 inches). Dimension 937 is 3.25 mm (0.128 inches). Dimension 938 is 1.50 mm (0.0591 inches). Dimension 939 is 0.75 mm (30 mils). Dimension 940 is 0.25 mm (9.8 mils). Dimension 941 is 0.13 mm (5.1 mils). Dimension 942 is 1.50 mm (0.0591 inches). Dimension 943 is 2.25 mm (0.0886 inches). Dimension 944 is 0.50 mm (20 mils). Dimension 945 is 1.50 mm (0.0591 inches). Dimension 946 is 1.75 mm (0.0689 inches). Dimension 947 is 0.06 mm (2 mils). Dimension 948 is 0.06 mm (2 mils). Dimension 949 is 0.75 mm (30 mils). Dimension 950 is 0.48 mm (19 mils). Dimension 951 is 0.50 mm (20 mils). Dimension 952 is 0.75 mm (30 mils).

Returning to FIG. 9H, sealing edge 953 is finished to 32 roughness. This finishing is necessary to assure a proper seal between capping structure 702 and the corresponding print cartridge so that the printhead is adequately sealed when the print cartridge is capped.

After assembly of sled 503, and mounting of sled 503 on springs 502, cam holder 504 is mounted over sled 503. Cam holder 504 is tilted and legs 504*e*, formed on either side of cam holder 504, are fitted into corresponding holes (not shown) formed in a side wall 501*a* of chassis 501. The opposite end of cam holder 504 is then lowered into contact with sled 503. Screws 505 are inserted through corresponding threaded holes 504*f* (only one is visible in FIG. 5) formed in cam holder 504. Screws 505 are tightened down so that the threaded end of each screw 505 contacts a wall 501*b* (only one is visible in FIG. 5) of chassis 501. Cam holder 504 is thereby held in place, since cam holder 504 cannot rotate about a contact point between legs 504*e* and corresponding holes, due to the contact between screws 505 and corresponding walls 501*b*.

Figure 11A:
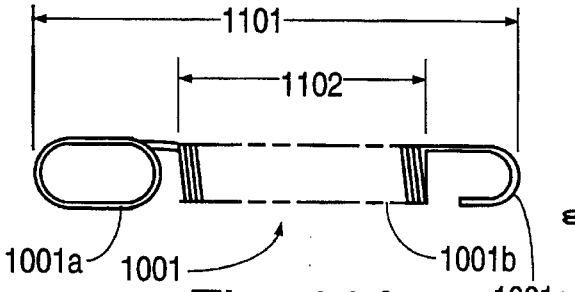
FIG. 11A is a side view of the spring, shown in FIG. 10, used to reduce noise associated with the operation of the service station.
Figure 11B:
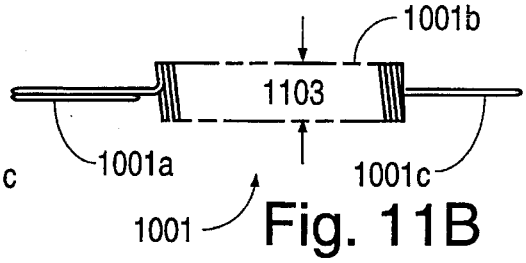
FIG. 11B is a side view, viewed in a direction perpendicular to the plane of FIG. 11A, of the spring of FIG. 11A.

FIG. 10 is an exploded perspective view of service station 500 of FIG. 5A, partially assembled, including a spring 1001 for reducing noise associated with the operation of service station 500. FIG. 11A is a side view of spring 1001. FIG. 11B is a side view, viewed in a direction perpendicular to the plane of FIG. 11A, of spring 1001.

As can be seen in FIG. 11A, spring 1001 is formed with a coil section 1001*b*. An oval loop section 1001*a* is formed at one end of coil section 1001*b*. A hook section 1001*c* is formed at the opposite end of coil section 1001*b*. Spring 1001 is made of 0.25 mm (9.8 mils) diameter stainless steel 302 spring wire. However, other suitable materials can be used. The nominal overall length 1101 of spring 1001 is 27.3 mm (1.07 inches). The nominal length 1102 of coil section 1001*b* is 14 mm (0.55 inches). The nominal width 1103 of coil section 1001*b* is 3.2 mm (0.13 inches). The inner radius of curvature of the curved portions of loop section 1001*a* is 1.7 mm (0.67 inches). The nominal length of loop section 1001*a* between inner surfaces of the loop is 6.9 mm (0.27 inches). The nominal length of the end of coil section 1001*b* near loop section 1001*a* to the center of curvature of the curved portion of loop section 1001*a* nearest coil section 1001*b* is 3 mm (0.1 inches). The inner radius of curvature of the curved portion of hook section 1001*c* is 1.4 mm (0.55 inches). The nominal length of hook section 1001*c* from the tip of the hook to the inner surface of the curved section is 3.4 mm (0.13 inches).

Returning to FIG. 10, hook section 1001*c* of spring 1001 is fitted around protrusion 504*a* formed on cam holder 504 (see FIG. 5). Loop section 1001*a* of spring 1001 is fitted around the cam follower extension 503*c* nearest protrusion 504*a*. When sled 503 moves to the uncapped position (to the right and into the plane of the paper in FIG. 10), spring 1001 is extended so that spring 1001 exerts a force on sled 503 that pulls sled 503 in a direction opposite the sled 503 movement. As a result, sled 503 is decelerated, reducing the force with which sled 503 strikes chassis 501 when sled 503 reaches the uncapped position, thereby reducing the noise of the impact.

Cam holder 504 is formed with slots 504*b* on each side of cam holder 504 near cam holder cam follower extensions 504*c* (corresponding to second cam follower members 12*a* of FIG. 3). When sled 503 is moved to the wipe position, sled cam surfaces 503*b* strike the cam holder cam follower extensions 504*c*, thereby generating noise. The presence of slots 504*b* imparts more flexibility to the extended sections 504*d* of cam holder 504 from which cam holder cam follower extensions 504*c* extend. Thus, upon impact of sled cam surfaces 503*b*, extended sections 504*d* bend slightly, absorbing some of the impact force and reducing the noise generated by the impact.

Bumper 802 is formed as part of one of wipers 703*a* (FIG. 7B) located at one end of wiper structure 703. Bumper 802 is made of the same material as wipers 703*a* and includes two protrusions having a triangular cross-section. Other sufficiently deformable material can be used and the bumps can have other cross-sectional shapes, such as circular. When sled 503 moves to the uncapped position, sled 503 strikes chassis 501, as described above. The presence of bumper 802 cushions the impact of sled 503 against chassis 501, thereby reducing the noise produced by the impact. The location of bumper 802 dictates the orientation of wiper structure 703 during assembly of service station 500 since, as is apparent, wiper structure 703 must be oriented so that bumper 802 will strike chassis 501 as described above.

According to the invention, wiper blades 703*a* have an improved structure that provides better wiping. Both the material and the shape of wiper blades 703*a* contribute to the improved wiping.

According to one embodiment of the invention, wiper structure 703 is made of polyurethane having a hardness measure between 60–85 durometer Shore A. In another embodiment, wiper structure 703 is made of polyurethane having a hardness measure of approximately 80 durometer Shore A. The use of polyurethane avoids problems with "shingling" of wipers 703*a* that has occurred in previous wipers made of rubber when those wipers are used in low humidity and low temperature environments.

Figure 12:
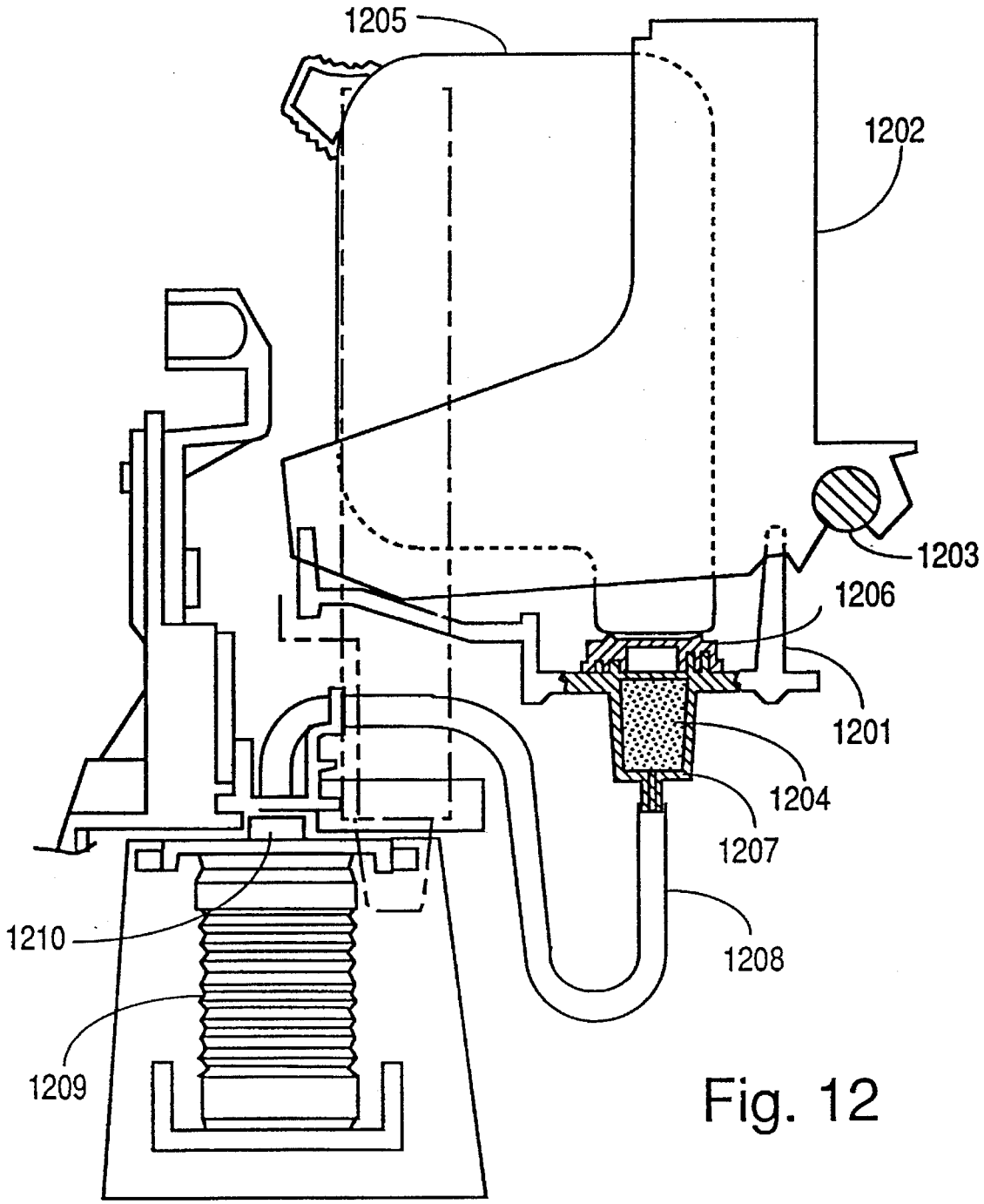
FIG. 12 is a cross-sectional view of a print carriage in the capped position illustrating structure for priming a print cartridge.

FIG. 12 is a cross-sectional view of print carriage 1202 after print carriage 1202 has been moved along slider bar 1203 into the capped position. (For clarity, some parts of the printer including this structure are not shown.) Print cartridge 1205 is held in a stall of print carriage 1202. The movement of print carriage 1202 into capping position moves sled 1201, as explained above, such that cap 1206 contacts print cartridge 1205 to form a sealed enclosure enclosing the printhead of print cartridge 1205.

FIG. 12 illustrates structure for priming print cartridge 1205. One end of flexible tube 1208 is attached to the bottom of reservoir 1207 formed at the bottom of sled 1201. Though not shown, a similar reservoir 1207 and flexible tube 1209 are formed beneath each of the caps 1206 of sled 1201. An opposite end of flexible tube 1208 is attached to vacuum 1209 by fitting 1210. Vacuum pressure is applied by vacuum 1209 through flexible tube 1208, reservoir 1207 and cap 1206 to the printhead of print cartridge 1205. The vacuum pressure draws ink from the ink reservoir of print cartridge 1205 into the firing chamber of print cartridge 1205. Filter 1204 is disposed within reservoir 1207 and absorbs ink that drops through cap 1205 into reservoir 1207.

While the present invention has been shown and described with reference to the foregoing operational principles and embodiments, it will be apparent to those skilled in the art that other changes in form and detail may be made therein without departing from the spirit and scope of the invention as defined in the appended claims.

We claim:

1. Structure for use with an inkjet printer, the printer including a chassis and a print carriage movably supported on the chassis, a print cartridge including a printhead through which ink is ejected being mounted in the print carriage, comprising:

a sled body having a longitudinal axis, a wiper mount extending in a direction transverse to the sled body longitudinal axis, formed on the sled body and being a protrusion from the sled body, said wiper mount having a pair of undercuts located at opposite ends of the wiper mount along the transverse direction;

an elastically deformable wiper, the wiper being mounted on and being substantially coextensive with the wiper mount, the wiper having a wiping edge extending distally from a surface of the sled body, the wiper being made of a material having a hardness between 60 and 85 durometer Shore A, the wiper being formed with a cavity, said wiper having end portions including a pair of inwardly extending wiper lips, the wiper being mounted on the wiper mount by a friction fit connection between said wiper lips and said undercuts of said mount such that the wiper mount is within the wiper cavity, said wiper edge extending transverse of the longitudinal axis of said sled body;

means for adjusting the position of the sled body relative to the printhead, the means for adjusting being capable of positioning the sled body relative to the printhead such that the wiping edge of the wiper contacts the printhead when the carriage is moved; and wherein, when the friction fitted wiper is mounted on the wiper mount, the wiper is deformed around the wiper mount such that the wiping edge of the wiper is concave.

2. Structure as in claim 1 wherein the wiper further comprises:

a blade section including the wiping edge;

an intermediate section adjacent a side of the blade section opposite the wiping edge, the intermediate section being thicker than the blade section; and a base section adjacent a side of the intermediate section opposite the blade section, the base section being thicker than the intermediate section.

3. Structure as in claim 1, wherein the concavity of the wiper edge of each of the wipers lies in a plane which is substantially perpendicular to a direction of movement of said carriage.

4. Structure for use with an inkjet printer, the printer including a chassis and a plurality of print cartridges movably supported on the chassis, the print cartridges each including a printhead through which ink is ejected, comprising:

a sled body having a longitudinal axis, a plurality of wiper mounts being formed on the sled body and extending in a direction transverse to the sled longitudinal axis;

a wiping structure including a plurality of wipers formed integrally, each of the wipers being mounted on and being substantially coextensive with a corresponding wiper mount, each of the wipers being elastically deformable and having a wiping edge extending distally from a surface of the sled body, each of the wipers being made of a material having a hardness between 60 and 85 durometer Shore A, each of the wipers being formed with a cavity and having inwardly extending wiper lips, each of the wipers being mounted on a corresponding wiper mount such that a corresponding wiper mount is within the wiper cavity, said wiper edge extending transverse to the longitudinal axis of said sled body;

means for adjusting the position of the sled body relative to the printheads, the means for adjusting being capable of positioning the sled body relative to the printheads such that the wiping edge of each of the wipers contacts a corresponding printhead; and wherein each corresponding wiper mount includes a pair of undercuts located at opposite ends of the wiper mount in the transverse direction, respective ones of said wiper lips being receivable in a friction fit connection in respective ones of said undercuts such that, when each of the wipers are mounted on the corresponding wiper mount, each of the wipers are deformed around the corresponding wiper mount such that the wiping edge of each of the wipers is concave.

5. Structure as in claim 4, wherein each of the wipers comprises a blade section for wiping the printhead of a print cartridge, wherein a first set of the wipers is for wiping the printheads of print cartridges containing pigmented ink, wherein a second set of the wipers is for wiping the printheads of print cartridges containing non-pigmented ink, and wherein the blade sections of said first set of wipers are thicker than the blade sections of said second set of wipers.

6. Structure as in claim 4, wherein each of the wipers further comprises:

a blade section including the wiping edge;

an intermediate section adjacent a side of the blade section opposite the wiping edge, the intermediate section being thicker than the blade section; and a base section adjacent a side of the intermediate section opposite the blade section, the base section being thicker than the intermediate section.

7. Structure as in claim 5, wherein the pigmented ink is a black ink.

* * * * *